US010081207B2

(12) United States Patent
Iwaya

(10) Patent No.: US 10,081,207 B2
(45) Date of Patent: Sep. 25, 2018

(54) RECORDING APPARATUS

(71) Applicant: SEIKO EPSON CORPORATION, Tokyo (JP)

(72) Inventor: Satoshi Iwaya, Ina (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/229,991

(22) Filed: Aug. 5, 2016

(65) Prior Publication Data

US 2016/0339725 A1 Nov. 24, 2016

Related U.S. Application Data

(62) Division of application No. 14/639,353, filed on Mar. 5, 2015, now Pat. No. 9,434,192.

(30) Foreign Application Priority Data

Mar. 14, 2014 (JP) ..... 2014-052605

(51) Int. Cl.
*B41J 29/13* (2006.01)
*B41J 29/02* (2006.01)
*B41J 2/01* (2006.01)

(52) U.S. Cl.
CPC ..... *B41J 29/02* (2013.01); *B41J 2/01* (2013.01); *B41J 29/13* (2013.01)

(58) Field of Classification Search
CPC ..... B41J 29/02; B41J 2/01; B41J 29/13
See application file for complete search history.

(56) References Cited

U.S. PATENT DOCUMENTS

| | | | |
|---|---|---|---|
| 5,369,429 | A | 11/1994 | Erickson |
| 6,065,831 | A | 5/2000 | Kawaura et al. |
| 7,213,914 | B2 | 5/2007 | Anma et al. |
| 7,350,910 | B2 | 4/2008 | Anma et al. |
| 8,091,998 | B2 | 1/2012 | Anma et al. |
| 8,136,930 | B2 | 3/2012 | Anma et al. |
| 8,628,179 | B2 | 1/2014 | Anma et al. |

(Continued)

FOREIGN PATENT DOCUMENTS

| | | |
|---|---|---|
| EP | 1 547 785 | 6/2005 |
| EP | 2 159 061 | 3/2010 |

(Continued)

OTHER PUBLICATIONS

European Search Report for Application No. 15158735.9 dated Sep. 27, 2016.

(Continued)

*Primary Examiner* — Julian Huffman
(74) *Attorney, Agent, or Firm* — Workman Nydegger

(57) ABSTRACT

A printer includes: a liquid ejecting head which performs recording on a paper sheet by ejecting liquid; a housing in which the liquid ejecting head is stored; an operating panel which is provide in the housing; a liquid storing body which stores the liquid supplied to the liquid ejecting head; and a case which accommodates the liquid storing body. When a direction in which a sign on the operating panel faces is considered as a front surface of the printer and the housing, the case is mounted on a right side surface of the housing, and the case is mounted on the housing in a state of being inclined with respect to a depth direction of the printer.

7 Claims, 25 Drawing Sheets

(56) References Cited

U.S. PATENT DOCUMENTS

| | | | | |
|---|---|---|---|---|
| 9,434,192 | B2 * | 9/2016 | Iwaya | B41J 29/02 |
| 2004/0125182 | A1 | 7/2004 | Akermalm et al. | |
| 2007/0013736 | A1 | 1/2007 | Higginson et al. | |
| 2007/0229625 | A1 | 10/2007 | Yano | |
| 2012/0056960 | A1 | 3/2012 | Williams | |
| 2014/0043408 | A1 * | 2/2014 | Kudo | B41J 2/175<br>347/86 |
| 2014/0063142 | A1 | 3/2014 | Miyazaki et al. | |
| 2015/0258827 | A1 | 9/2015 | Iwaya | |

FOREIGN PATENT DOCUMENTS

| | | |
|---|---|---|
| JP | 2003053984 | 2/2003 |
| JP | 2004284353 | 10/2004 |
| JP | 2007136748 | 6/2007 |
| JP | 2009-202346 | 9/2009 |
| JP | 4533125 B | 6/2010 |

OTHER PUBLICATIONS

U.S. Appl. No. 14/639,353, Oct. 23, 2015, Restriction Requirement.
U.S. Appl. No. 14/639,353, Feb. 2, 2016, Office Action.
U.S. Appl. No. 14/639,353, May 6, 2016, Notice of Allowance.

* cited by examiner

RECORDING APPARATUS

BACKGROUND

1. Technical Field

The present invention relates to a recording apparatus which performs recording by ejecting liquid from a recording portion.

2. Related Art

In the related art, an ink jet type printer, which performs printing (recording) by ejecting ink (liquid) with respect to a recording medium, such as a paper sheet, from a liquid ejecting head (recording portion), is known as one type of a recording apparatus. In such a printer, in order to sequentially and stably supply the ink to the liquid ejecting head even when a relatively large amount of printing is performed, a configuration in which an ink bag (liquid storing body) having a relatively large storing capacity of the ink is provided, is suggested (for example, refer to JP-A-2009-202346).

In the recording apparatus in JP-A-2009-202346, the ink is supplied through an ink supply tube to the liquid ejecting head which is provided inside a housing from the ink bag which is provided outside the housing. In this recording apparatus, the housing and the ink bag are provided separately, and it is necessary to separately move the housing and the ink bag when moving the printer. In this regard, if a case made of resin is mounted on the housing, and the ink bag is accommodated in the case, it is possible to move the housing and the ink bag together when moving the printer. In addition, in Japanese Patent No. 4,533,125, a recording apparatus, which has a curved side surface of the housing, is disclosed.

Meanwhile, in order to reduce a manufacturing cost, it is considered to mount a case which is common with respect to other types of apparatuses. However, the shape of the housing is various every type of apparatus, and some housings have a curved side surface as disclosed in Japanese Patent No. 4,533,125. For this reason, when the common case is employed, there is a concern that a void is generated when mounting the case on the housing. In particular, when a case in a shape of a rectangular parallelepiped is mounted on the housing having the curved side surface similarly to the recording apparatus disclosed in Japanese Patent No. 4,533,125, generation of a void is inevitable.

In addition, if the void which is generated between the case and the housing in this manner is remarkable, there is a concern that an external appearance of the printer is damaged.

In addition, this problem is not an issue just for the ink jet type printer, but is a generally common issue in the recording apparatus which performs recording by ejecting the liquid which is supplied to the recording portion that is provided inside the housing from the liquid storing body that is provided outside the housing, from the recording portion to the recording medium.

In addition, if the width in a depth direction is constant, the recording apparatus tends to be seen to be recessed.

SUMMARY

An advantage of some aspects of the invention is to provide a recording apparatus in which a void between a housing and a case is not remarkable, or to provide a configuration in which the recording apparatus is not seen to be recessed.

According to an aspect of the invention, there is provided a recording apparatus, including: a recording portion which performs recording on a recording medium by ejecting liquid; a housing in which the recording portion is stored; an operating panel which is provided in the housing; a liquid storing body which stores the liquid supplied to the recording portion; and a case which accommodates the liquid storing body. When a direction in which a sign on the operating panel faces is considered as a front surface of the recording apparatus and the housing, the case is mounted on at least one of a right side surface and a left side surface of the housing, and the case is mounted on the housing in a state of being inclined with respect to a depth direction of the recording apparatus so that an outer surface which opposes the housing in the case is positioned on an inner side of the recording apparatus in a width direction as approaching a near side of the recording apparatus in the depth direction.

According to another aspect of the invention, there is provided a recording apparatus, including: a recording portion which performs recording on a recording medium by ejecting liquid; a housing in which the recording portion is stored; an operating panel which is provided in the housing; a liquid storing body which stores the liquid supplied to the recording portion; and a case which accommodates the liquid storing body. When a side on which the operating panel is provided is considered as a front surface of the recording apparatus and the housing, the case is mounted on at least one of a right side surface and a left side surface of the housing, and the case is mounted on the housing in a state of being inclined with respect to a depth direction of the recording apparatus so that an outer surface which opposes the housing in the case is positioned on an inner side of the recording apparatus in a width direction as approaching a near side of the recording apparatus in the depth direction.

In these cases, when the recording apparatus is viewed from the front surface, the case is inclined so that a part on the nearest side of the outer surface which opposes the housing in the case becomes closer to a side surface on which the case is mounted in the housing. For this reason, compared to a case where the case is mounted without inclination in the depth direction of the recording apparatus, a void between the housing and the case, which is seen from the front surface, becomes smaller. Therefore, the void between the housing and the case becomes less remarkable.

In the recording apparatus according to the aspect of the invention, it is preferable that the width on the near side of the recording apparatus in the depth direction is narrower than that in a center portion.

When the width of the recording apparatus is constant, when the recording apparatus is viewed from the front surface, a far part of the recording apparatus tends to be seen as narrowed, and there is a concern that a side wall of the recording apparatus is recognized as recessed.

In contrast, in this case, since the width of the recording apparatus which includes the case that is mounted on the housing in a state of being inclined increases as approaching a far side, when viewed from the front surface, the side wall of the recording apparatus becomes less recognizable as recessed.

In addition, in this case, if the case is positioned on a further side than the part on the nearest side of the housing in the depth direction of the recording apparatus, since the case does not become a projected shape on a nearer side than the housing, the case is unlikely to become an obstacle.

In the recording apparatus according to the aspect of the invention, it is preferable that the side surface of the housing on which the case is mounted is inclined with respect to a height direction of the recording apparatus, and that the case is mounted on the housing in a state of being inclined with respect to the height direction of the recording apparatus to be along the inclined side surface of the housing.

When the side surface of the housing is inclined with respect to the height direction of the recording apparatus, if the case is mounted without inclination in the height direction of the recording apparatus, the void is generated between the housing and the case above and below the recording apparatus. In this regard, in the above-described configuration, generation of the void is suppressed.

In the recording apparatus according to the aspect of the invention, it is preferable that a sealing member is nipped between the housing and the case.

In this case, since the void between the housing and the case is blocked by the sealing member, it is possible to prevent an object from getting into the void between the housing and the case.

According to still another aspect of the invention, there is provided a recording apparatus, including: a recording portion which performs recording on a recording medium by ejecting liquid; a housing in which the recording portion is stored; an operating panel which is provided in the housing; a liquid storing body which stores the liquid supplied to the recording portion; and a case which accommodates the liquid storing body. When a side on which the operating panel is provided is considered as a front surface of the recording apparatus and the housing, the case is mounted on at least one of a right side surface and a left side surface of the housing, and the case is mounted on the housing in a state of being inclined with respect to a depth direction of the recording apparatus so that a distance from an outer surface which opposes the housing in the case to a side surface of the housing on which the case is mounted becomes shorter as approaching a near side in the depth direction of the recording apparatus.

According to still another aspect of the invention, there is provided a recording apparatus, including: a recording portion which performs recording on a recording medium by ejecting liquid; a housing in which the recording portion is stored; a liquid storing body which stores the liquid supplied to the recording portion; and a case which accommodates the liquid storing body. When a discharge port which discharges the recording medium is provided on the housing, and a direction in which the discharge port is provided is considered as a front surface of the recording apparatus and the housing, the case is mounted on at least one of a right side surface and a left side surface of the housing, and the case is mounted on the housing in a state of being inclined with respect to a depth direction of the recording apparatus so that an outer surface which opposes the housing in the case is positioned on an inner side of the recording apparatus in a width direction as approaching a near side of the recording apparatus in the depth direction.

In these cases, when the recording apparatus is viewed from the front surface, the case is inclined so that a part on the nearest side of the outer surface which opposes the housing in the case becomes closer to the side surface on which the case is mounted. For this reason, compared to a case where the case is mounted without inclination in the depth direction of the recording apparatus, a void between the housing and the case, which is seen from the front surface becomes smaller. Therefore, the void between the housing and the case becomes less remarkable.

In the recording apparatus according to the aspect of the invention, it is preferable that a first sheet metal is provided on a surface on the housing side of the case, a second sheet metal is provided on a surface on a side opposite to the case of the housing, and the first sheet metal and the second sheet metal are fastened with each other by a fastening member.

In the recording apparatus according to the aspect of the invention, it is preferable that the first sheet metal is protruded to the housing side in accordance with the width of the case.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a recording apparatus will be described with reference to FIGS. 1 to 26. In addition, the embodiment illustrates an example in which the recording apparatus is specified as an ink jet type printer (hereinafter, simply refer to a "printer").

Figure 1:
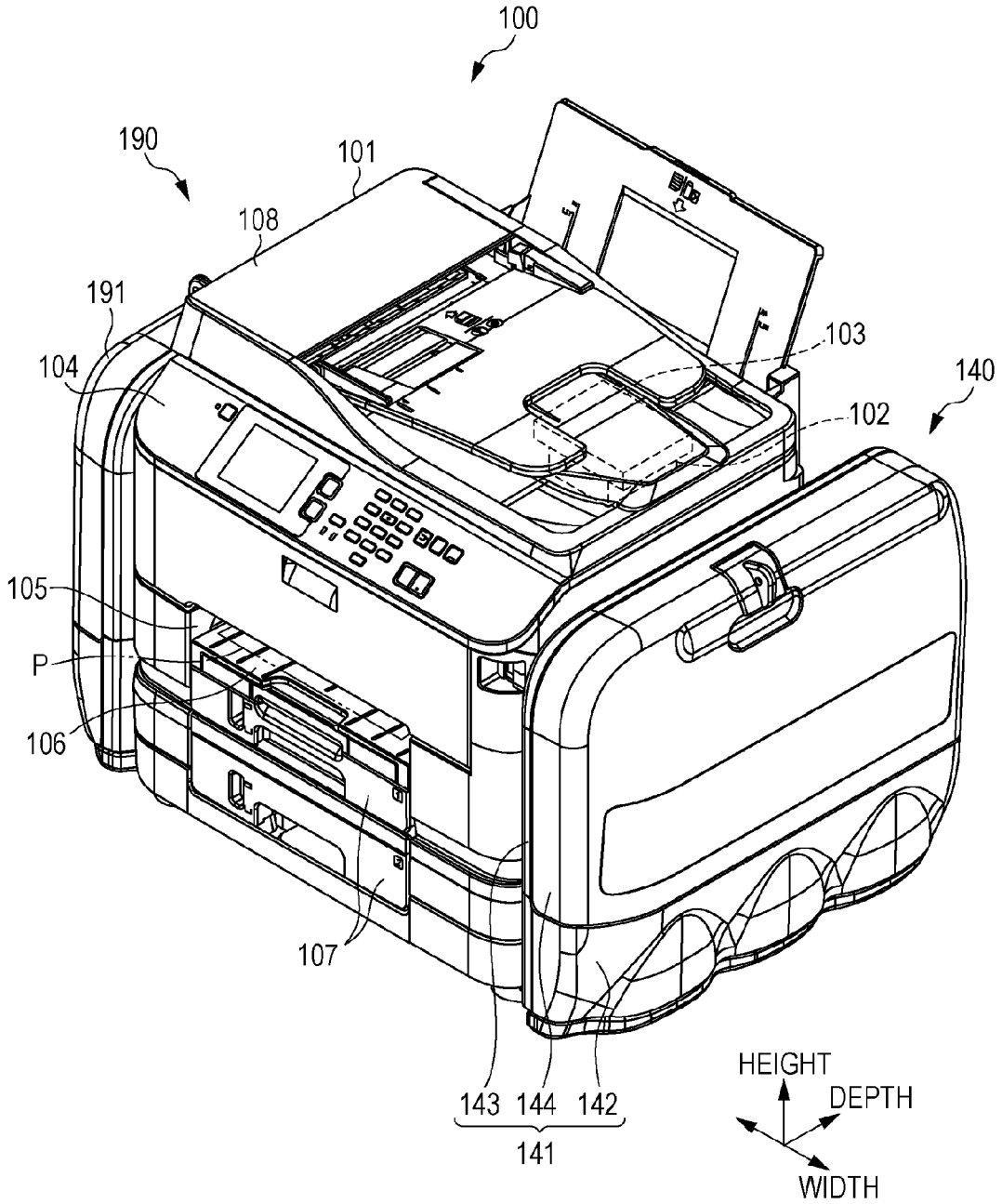
FIG. 1 is a perspective view of a recording apparatus according to a first embodiment.

As illustrated in FIG. 1, the printer includes a recording unit 100 which performs recording on a paper sheet P which is an example of a recording medium, by ejecting ink which is an example of liquid, and two liquid storing units 140 and 190 which supply the ink to the recording unit 100.

In the recording unit 100, a housing 101 which is made of resin is provided. In the housing 101, a liquid ejecting head 102 which is an example of a recording portion that performs recording on the paper sheet P by ejecting the ink, and a carriage 103 which supports the liquid ejecting head 102, are provided. In addition, in the housing 101, an operating panel 104 for operating the printer by a user is provided.

In addition, hereinafter, a direction, in which a sign of a monitor or a button faces in the operating panel 104, is considered as a front surface of the housing 101. In other words, the operating panel 104 is provided on the front surface side in the housing 101.

In addition, in FIG. 1, a depth direction and a height direction of the printer, and a width direction which is orthogonal to the depth direction and the height direction of the printer, are respectively illustrated by arrows.

The carriage 103 can reciprocate in the width direction of the printer inside the housing 101. As the liquid ejecting head 102 ejects the ink while reciprocating in the width direction of the printer according to the movement of the carriage 103, recording (printing) is performed on the paper sheet P.

In addition, on the front surface of the housing 101, a rectangular discharge port 105, which discharges the paper sheet P on which recording is performed inside the housing 101 to the outside of the housing 101, is provided. The paper sheet P which is discharged from the discharge port 105 is loaded on a paper discharging tray 106. In addition, below the paper discharging tray 106 on the front surface of the housing 101, two stages of upper and lower paper supply cassettes 107 are mounted attachably and detachably. In these paper supply cassettes 107, it is possible to store the plurality of paper sheets P in a stacked state.

In addition, in an upper part of the housing 101 of the recording unit, a scanner portion 108, in which a scanner that reads an image recorded on an original document which is set at a predetermined reading position, is stored.

A first liquid storing unit 140 is attached to a right side surface of the housing 101. In addition, a second liquid storing unit 190 is attached to a left side surface of the housing 101.

Figure 2:
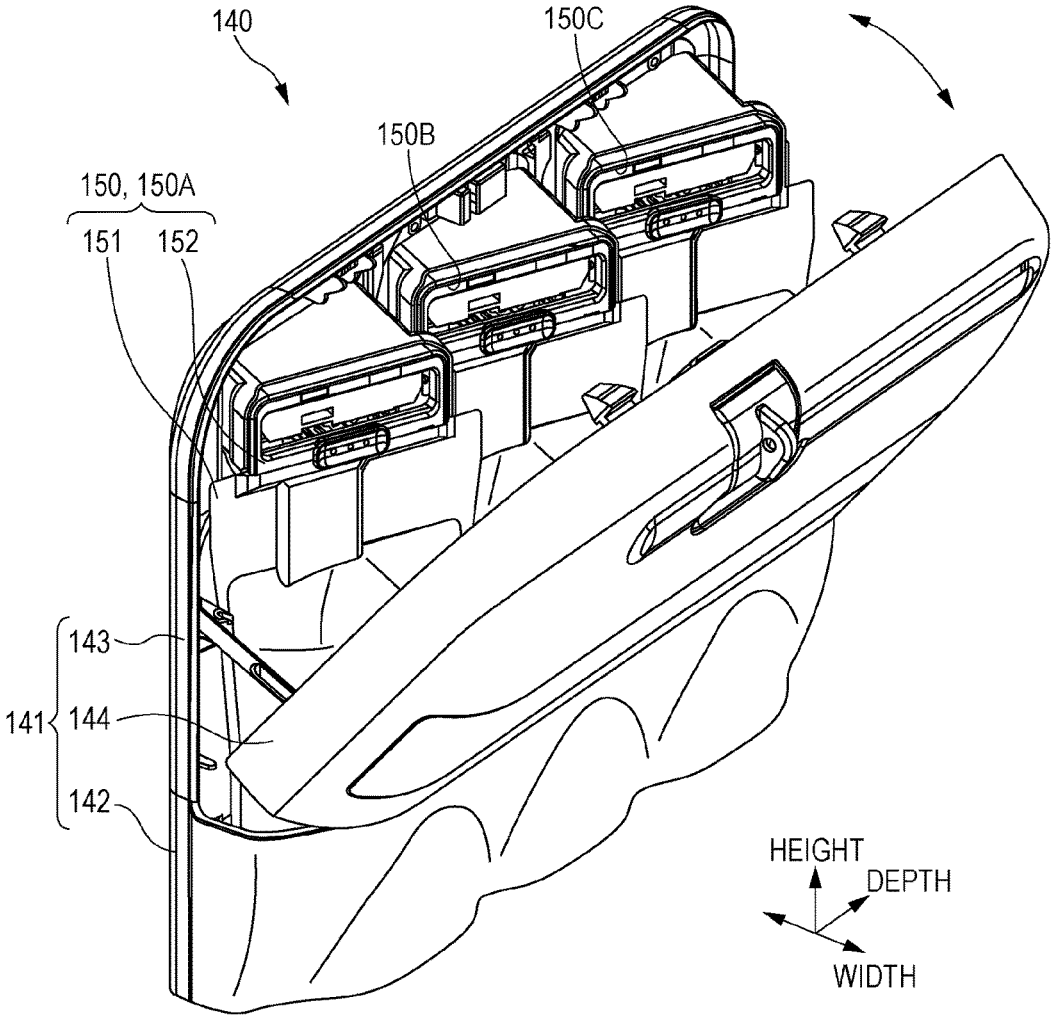
FIG. 2 is a perspective view of a first liquid storing unit in a state where a lid body is opened.

As illustrated in FIGS. 1 and 2, the first liquid storing unit 140 includes a case 141 which is made of resin, and a plurality of liquid storing bodies 150 which are accommodated in the case 141. The case 141 is configured of a bottom forming member 142 which has a shape of a bottomed box and forms a bottom of the case 141, a side wall forming member 143 which is linked to an upper end of a side wall which opposes the housing 101 in the bottom forming member 142, and a lid body 144 which is rotatably linked to an upper end of the bottom forming member 142. The lid body 144 abuts against an upper end of the side wall forming member 143, and opens/closes the case 141 by being apart. In addition, the case 141 is formed in a shape of a substantially rectangular parallelepiped.

As illustrated in FIG. 2, the liquid storing bodies 150 which is accommodated in the case 141 includes an ink bag 151 which is made of a flexible material and which stores color ink, and a handle portion 152 which has a rectangular annular shape and which is fixed to an upper end portion of the ink bag 151. As the liquid storing bodies 150, from a near side of the printer in the depth direction, a first liquid storing body 150A, a second liquid storing body 150B, and a third liquid storing body 150C, are attached to the first liquid storing unit 140 in order. In the first liquid storing body 150A, for example, yellow ink is stored, in the second liquid storing body 150B, for example, magenta ink is stored, and in the third liquid storing body 150C, for example, a cyan ink is stored.

Figure 3:
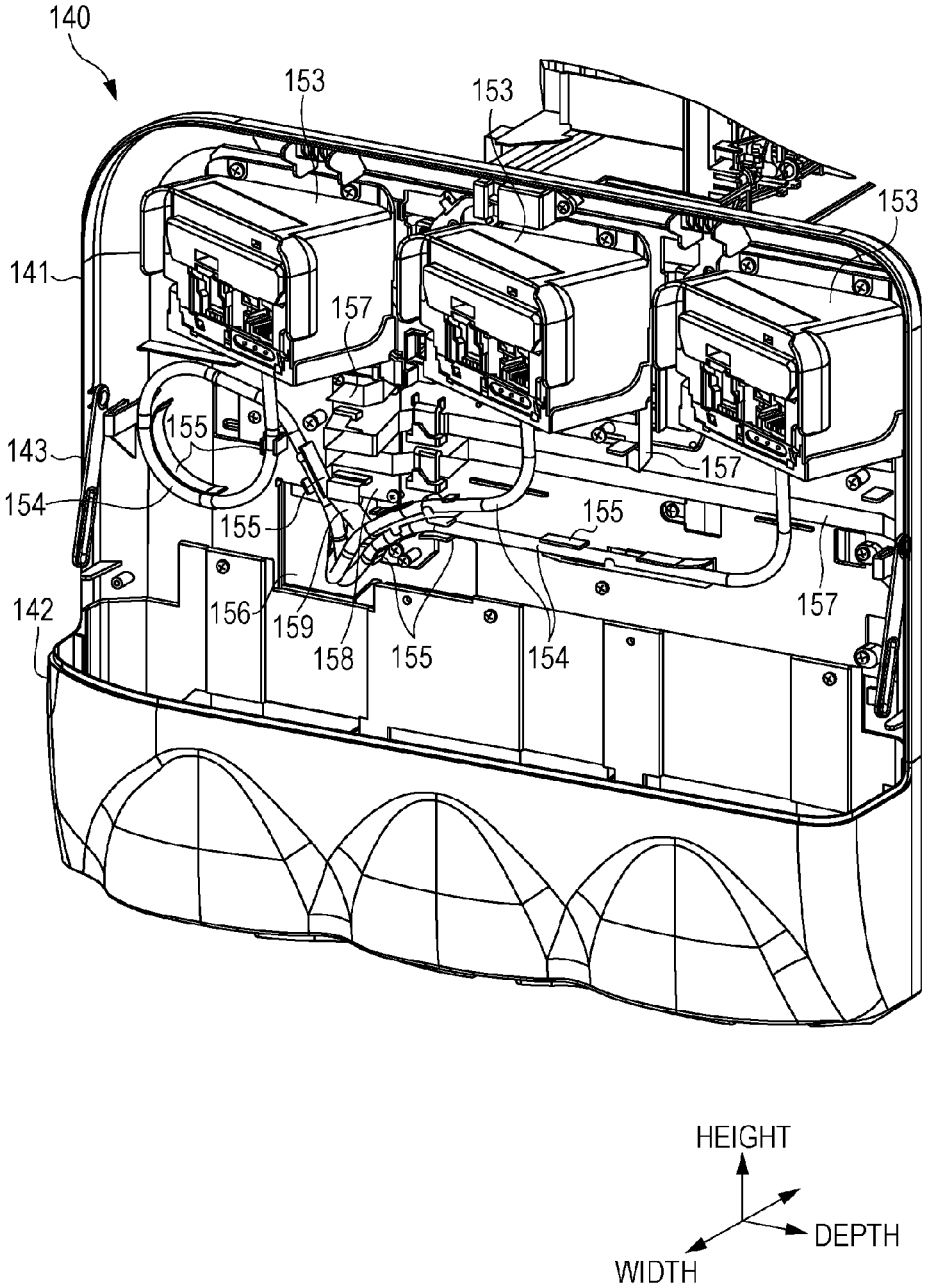
FIG. 3 is a perspective view of the first liquid storing unit in a state where the lid body and a cover are detached.

As illustrated in FIG. 3, on a wall surface of the side wall forming member 143 on an inner side of the case 141, a plurality of stays 153, to which the liquid storing bodies 150 are attached, are provided. The liquid storing body 150 is attached to the stay 153 attachably and detachably as the handle portion 152 of the liquid storing body 150 is fitted into the stay 153. In other words, the stay 153 functions as a liquid storing body maintaining portion which maintains the liquid storing body 150. In addition, ink supplying tubes 154 are connected to each stay 153. The ink supplying tubes 154 are respectively supported in a curved shape by each clamp 155 which is provided on an inner surface of the case 141, and are drawn to the outside of the case 141 through a tube inserting hole 156 which is provided in the side wall forming member 143. In addition, a cover, which hides the ink supplying tube 154 that is drawn to the inside of the case 141, is attached to the inside of the case 141, but FIG. 3 illustrates a state where the cover and the lid body 144 are detached.

The ink supplying tube 154 which is drawn to the outside of the case 141 is introduced into the housing 101 of the recording unit 100. For this reason, when the liquid storing body 150 is attached to the stay 153, the ink which is stored in the liquid storing body 150 is supplied to the recording unit 100 via the ink supplying tube 154. The ink which is supplied to the recording unit 100 is supplied to the liquid ejecting head 102 through an ink supply system which is provided in the recording unit 100, and is ejected from the liquid ejecting head 102.

In addition, one ends of individual cables 157 which are flexible flat cables are connected to each stay 153. The other ends of the individual cables 157 are attachably and detachably connected to a relay substrate 158 which is provided on the inner surface of the case 141. Integrated cables 159 which are flexible flat cables that are electrically connected to each of the individual cable 157 through the relay substrate 158, are attachably and detachably connected to the relay substrate 158. The integrated cable 159 is drawn to the outside of the case 141 through the tube inserting hole 156 which is provided in the case 141, and introduced to the inside of the housing 101 of the recording unit 100 in the outside of the case 141. The integrated cable 159 which is introduced into the recording unit 100 is connected to a main substrate via an information transfer system which is provided inside the housing 101. In other words, each stay 153 and the main substrate are electrically connected to each other through these cables or the like.

Here, in the handle portion 152 of the liquid storing body 150, an IC chip, in which information, such as a residue or a type of the ink stored in the ink bag 151, is stored, is provided. For this reason, when the liquid storing body 150 is attached to the stay 153, the IC chip and the main substrate are electrically connected to each other, and the main substrate performs various controls of the printer based on the information stored in the IC chip. In addition, when the residue of the ink which is stored in the liquid storing body 150 is equal to or less than a predetermined amount, the main substrate outputs a signal urging an exchange of the liquid storing body 150.

Figure 4:
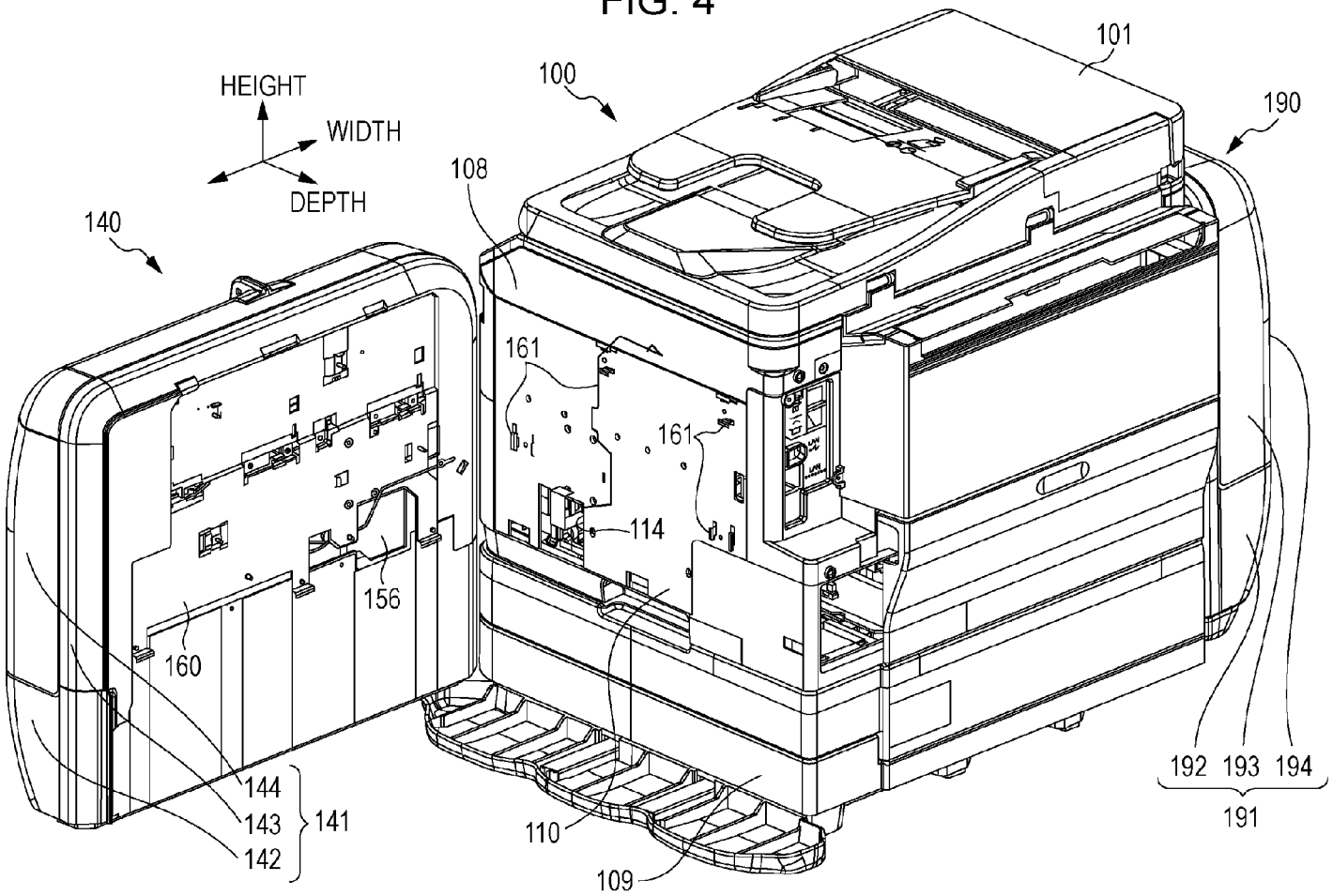
FIG. 4 is a perspective view of the recording apparatus illustrating a state where the first liquid storing unit is rotated.

However, as illustrated in FIG. 4, an outer sheet metal 160 which is an example of a first sheet metal is attached to the wall surface of the side wall forming member 143 which is an outer surface that opposes the housing 101 of the case 141. In addition, an inner sheet metal 161 which is an example of a second sheet metal is attached to the inner surface of the housing 101 of the printer. As the outer sheet metal 160 and the inner sheet metal 161 are fastened by a screw, the case 141 is mounted on the housing 101.

Next, with reference to FIGS. 4 to 16, a structure of a fixing portion which fixes the first liquid storing unit 140 to the right side surface of the housing 101 will be described in detail.

As illustrated in FIG. 4, the housing 101 of the recording unit 100 is configured of a base frame 109 which is a base of the printer, a middle housing 110 which is attached onto the base frame 109 and supported by the base frame 109, and the scanner portion 108 which is provided at an upper part of the middle housing 110 and stores the scanner.

Figure 5:
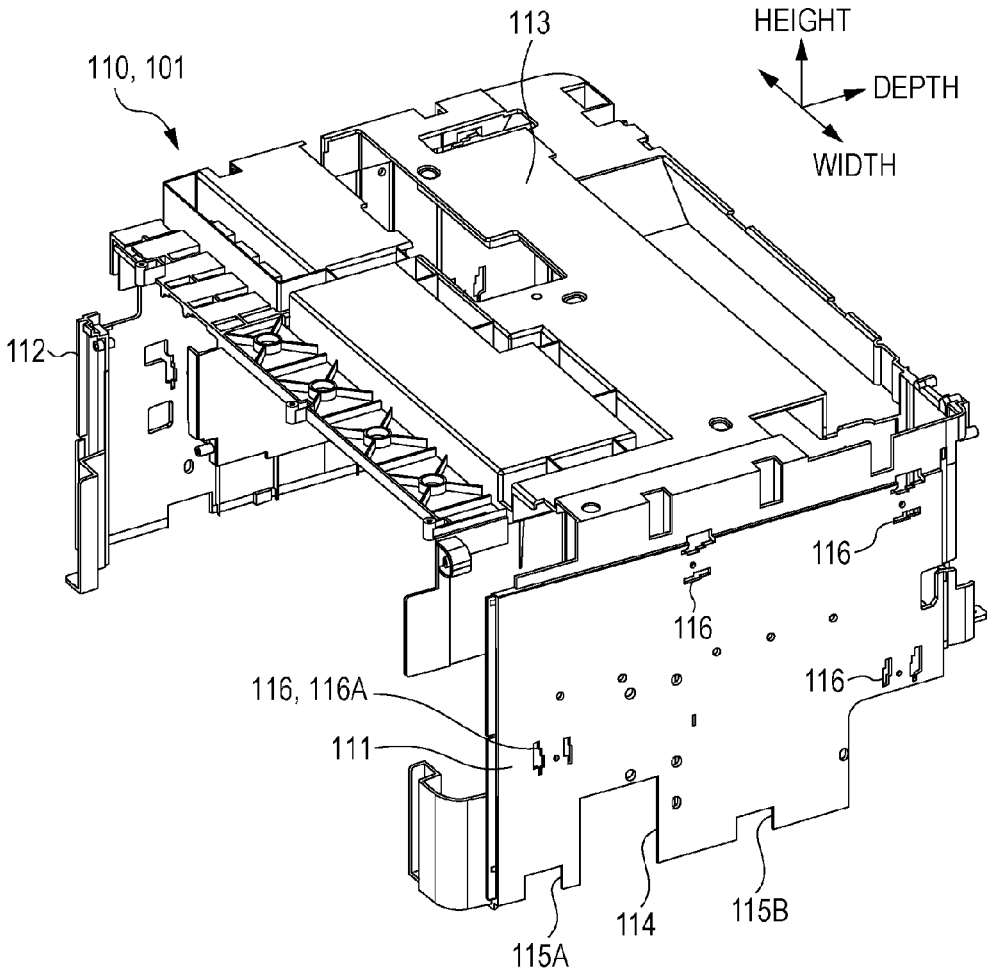
FIG. 5 is a perspective view of a middle housing which constitutes the housing.

As illustrated in FIG. 5, the middle housing 110 includes a right side wall portion 111, a left side wall portion 112, and a ceiling portion 113 which is connected to upper ends of both side wall portions 111 and 112. Both side wall portions 111 and 112 are exposed to the outside in a state of being assembled to the printer, and the first liquid storing unit 140 is mounted on a wall surface of the right side wall portion 111.

In the right side wall portion 111, a concave portion 114 which is cut out from a lower end thereof. As illustrated in FIG. 4, the concave portion 114 is provided at a position which is opposite to the tube inserting hole 156 which is provided in the case 141 of the first liquid storing unit 140. For this reason, the ink supplying tube 154 and the integrated cable 159 which are drawn to the outside of the case 141 through the tube inserting hole 156 is guided into the housing 101 through the concave portion 114 of the middle housing 110.

In addition, as illustrated in FIG. 5, two cutout portions 115A and 115B are formed to nip the concave portion 114 at a lower end of the right side wall portion 111.

However, in a case where a width of the printer is constant, when the printer is viewed from a front surface, there is a tendency that a far side is seen to be narrowed. For this reason, in the depth direction of the printer, the right side wall portion 111 of the middle housing 110 is formed in a slightly curved shape so that the length of the printer in the width direction decreases as approaching the near side and the far side, that is, so that a center part is protruded to the outer side in the width direction of the printer. In addition, the right side wall portion 111 of the middle housing 110 is formed in a slightly inclined shape with respect to the height direction of the printer so that the right side wall portion 111 is disposed on the outer side as approaching a lower part of the printer in the height direction, that is, so that the length of the printer in the width direction becomes longer.

In the right side wall portion 111 which is formed in this shape, an attaching hole 116, into which the inner sheet metal 161 is pressed, is formed. In addition, the attaching holes 116 are formed at four locations including two locations above and two locations below.

Next, a structure of the attaching hole 116 will be described in detail with reference to FIG. 6. In addition, FIG. 6 is an enlarged view when an attaching hole 116A which is positioned on the near side in the depth direction of the housing 101, among the two attaching holes 116 provided below, is viewed from the inner side of the housing 101.

Figure 6:
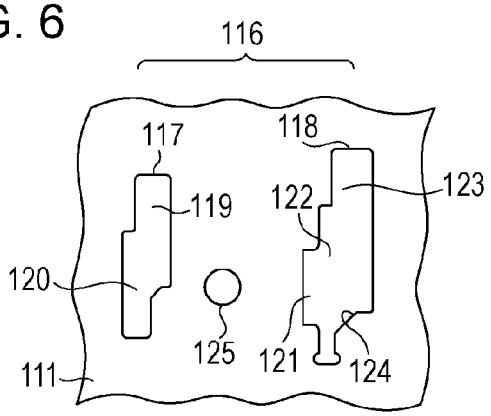
FIG. 6 is an enlarged view of an attaching hole which is provided in the middle housing.

As illustrated in FIG. 6, the attaching hole 116 is configured of a first attaching hole 117 which is disposed on a left side in FIG. 6 and extends in a vertical direction in FIG. 6, and a second attaching hole 118 which is disposed on a right side in FIG. 6 and is longer than the first attaching hole 117 in the vertical direction. In addition, when an upper part in the first attaching hole 117 is an upper hole portion 119, and a lower part is a lower hole portion 120, a step is formed between the upper hole portion 119 and the lower hole portion 120, and the lower hole portion 120 is positioned on the further left side compared to the upper hole portion 119. In addition, the second attaching hole 118 includes an inner side hole portion 121 which is positioned on the first attaching hole 117 side, an attaching hole portion 122 which is longer than the inner side hole portion 121 in the vertical direction, and an outer side hole portion 123 which extends further upward than the attaching hole portion 122. In addition, positions of an upper ends and a lower ends of the inner side hole portion 121, the attaching hole portion 122, and the outer side hole portion 123 are different from each other, and the step is formed at a part where these portions are connected to each other. In addition, among the steps between the attaching hole portion 122 and the outer side hole portion 123, a step 124 which is formed on a lower side in FIG. 6 is inclined. In addition, a screw inserting hole 125 in a substantially circular shape is provided between the first attaching hole 117 and the second attaching hole 118.

Figure 7A:
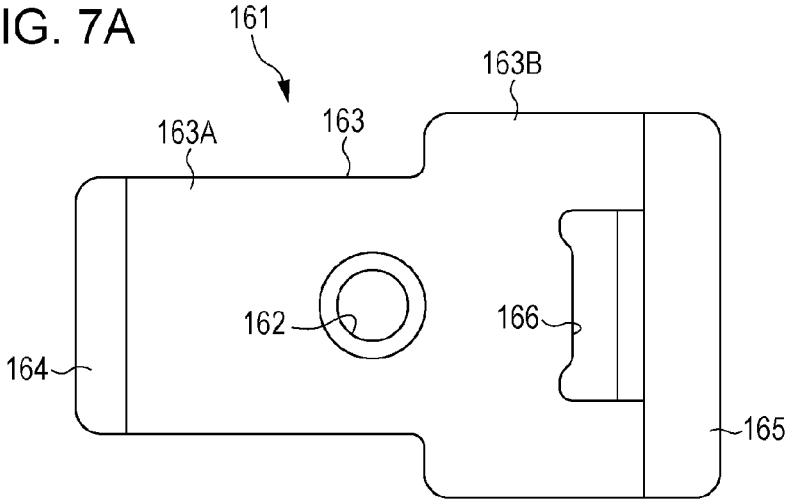
FIG. 7A is an upper view of an inner sheet metal.
Figure 7B:
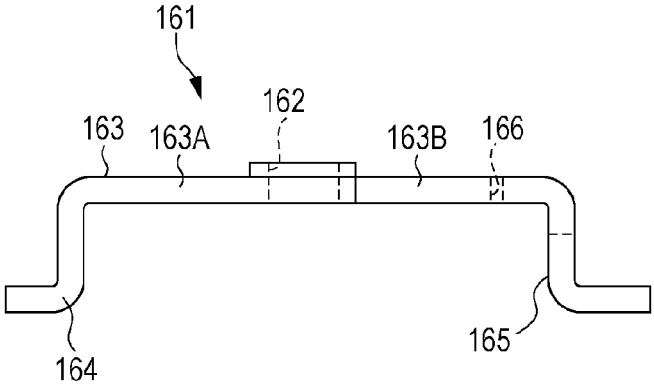
FIG. 7B is a side view of the inner sheet metal.

As illustrated in FIGS. 7A and 7B, the inner sheet metal 161 includes a ceiling portion 163 which is provided with a screw hole 162 for fastening a screw. As illustrated in FIG. 7A, the ceiling portion 163 includes a narrow width portion 163A which is provided with the screw hole 162, and a wide width portion 163B which is wider than the narrow width portion 163A. As illustrated in FIG. 7B, in the narrow width portion 163A, a first maintaining portion 164 which extends substantially perpendicularly from the narrow width portion 163A and in which an end portion is bent outward, is provided. In addition, in the wide width portion 163B, a second maintaining portion 165 which extends substantially perpendicularly from the wide width portion 163B and in which an end portion is bent outward, is provided. At a part where the second maintaining portion 165 and the wide width portion 163B are connected to each other, a long hole 166 which extends in a longitudinal direction (vertical direction in FIG. 7A) of the inner sheet metal 161 is formed at the center thereof. In other words, the length of the long hole 166 in the longitudinal direction (vertical direction in FIG. 7A) is different from the length in a transverse direction (horizontal direction in FIG. 7A).

Next, with reference to FIGS. 8A to 8F, an example of an attaching method of the inner sheet metal 161 to the right side wall portion 111 of the middle housing 110 will be described.

Figure 8A:
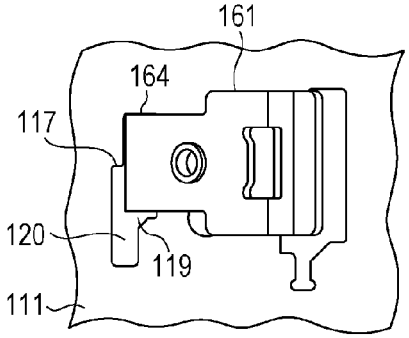
FIGS. 8A to 8F are views illustrating examples of a state where the inner sheet metal is attached to the middle housing.
Figure 8D:
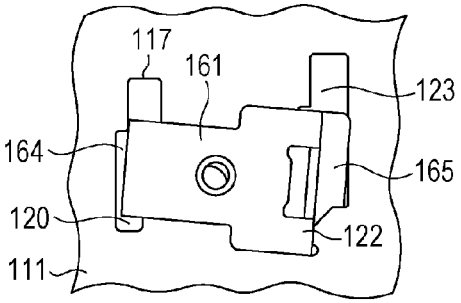
Figure 8B:
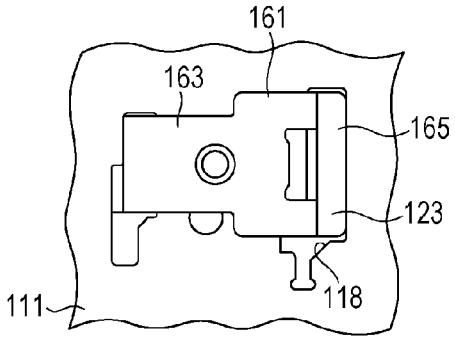
Figure 8E:
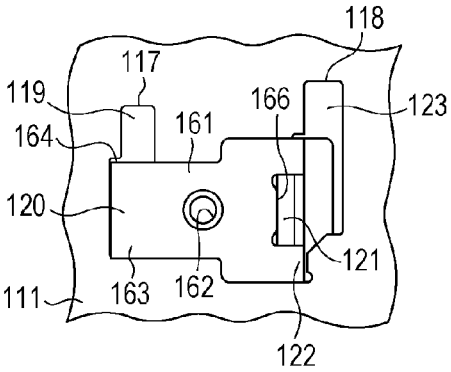
Figure 8C:
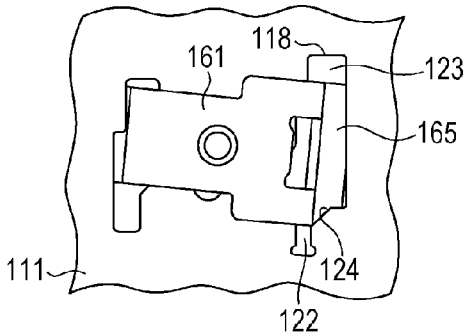
Figure 8F:
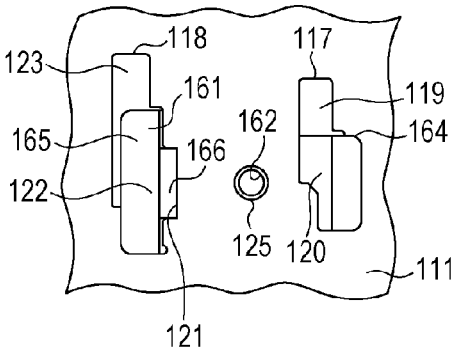

When attaching the inner sheet metal 161 to the right side wall portion 111 of the middle housing 110, first, as illustrated in FIG. 8A, the first maintaining portion 164 of the inner sheet metal 161 is inserted through the upper hole portion 119 of the first attaching hole 117 which is provided in the right side wall portion 111. Then, as illustrated in FIG. 8B, the inner sheet metal 161 is thrown down so that the ceiling portion 163 of the inner sheet metal 161 and the wall surface of the right side wall portion 111 oppose each other, and the second maintaining portion 165 of the inner sheet metal 161 is inserted through the outer side hole portion 123 of the second attaching hole 118 which is provided in the right side wall portion 111. After this, as illustrated in FIG. 8C, the second maintaining portion 165 side of the inner sheet metal 161 is slid downward in FIG. 8C. At this time, since the step 124 between the outer side hole portion 123 and the attaching hole portion 122 of the second attaching hole 118 is inclined, the inner sheet metal 161 is led to the attaching hole portion 122 along this inclination. After this, as illustrated in FIG. 8D, the entire inner sheet metal 161 is slid downward, and the second maintaining portion 165 is pushed down to the lower end of the attaching hole portion 122. In addition, when the inner sheet metal 161 is slid downward, the first maintaining portion 164 of the inner sheet metal 161 is gradually inserted through the lower hole portion 120 of the first attaching hole 117. After this, as illustrated in FIG. 8E, the first maintaining portion 164 is pushed down to the lower end of the lower hole portion 120. As illustrated in FIGS. 8E and 8F, when the inner sheet metal 161 is pushed down to the lower end of the attaching hole 116, the screw hole 162 which is provided in the inner sheet metal 161 is in a state of being overlapped with the screw inserting hole 125 which is provided in the right side wall portion 111, and the long hole 166 of the inner sheet metal 161 is in a state of being overlapped with the inner side hole portion 121 of the second attaching hole 118. In addition, FIG. 8F is a view illustrating a state where the state in FIG. 8E is viewed from an opposite side, that is, a state when viewed from the outer side of the housing 101.

Here, a distance between the lower hole portion 120 of the first attaching hole 117 and the attaching hole portion 122 of the second attaching hole 118 is shorter than the length of the ceiling portion 163 of the inner sheet metal 161 in the transverse direction (horizontal direction in FIGS. 8A to 8F). For this reason, when the inner sheet metal 161 is attached to the attaching hole 116, the inner sheet metal 161 is in a state of being nipped by the first attaching hole 117 and the second attaching hole 118. In addition, since the step is formed in the first attaching hole 117 or the second attaching hole 118, when the inner sheet metal 161 is pushed down to the lower end of the attaching hole 116, an upper end portion of the inner sheet metal 161 is unlikely to be caught by the step. For this reason, when the inner sheet metal 161 is once pressed into the attaching hole 116 in this configuration, the inner sheet metal 161 is maintained by the attaching hole 116 and is unlikely to be shifted.

Figure 9:
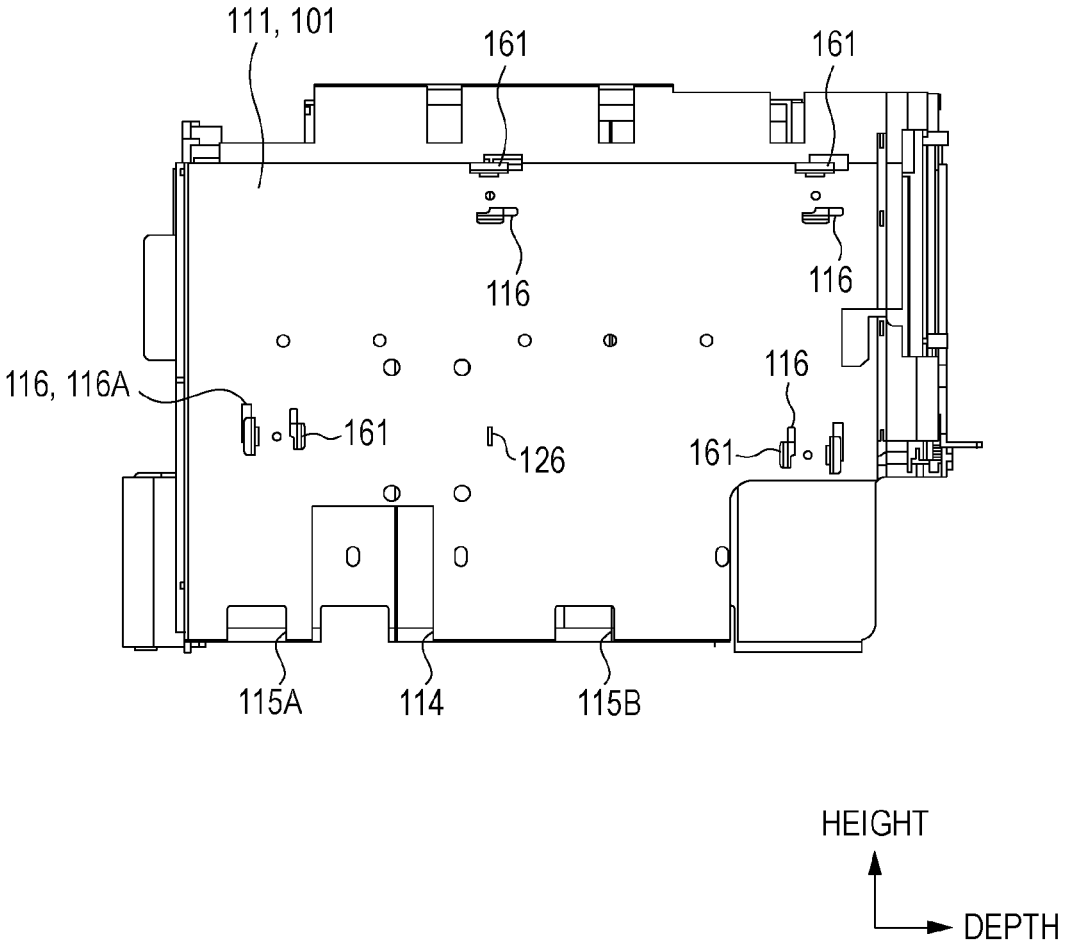
FIG. 9 is a left side view of the middle housing to which the inner sheet metal is attached.

FIG. 9 illustrates a state after the inner sheet metals 161 are attached to all of the attaching holes 116 of the right side wall portion 111. As illustrated in FIG. 9, two attaching holes 116 which are provided above, are provided with a different orientation from each of the attaching holes 116 which are provided below. For this reason, the inner sheet metal 161 which is pressed into the attaching hole 116 provided above, among the inner sheet metals 161 which are attached to the right side wall portion 111, has a different orientation in which the long hole 166 extends from that of other inner sheet metals 161. More specifically, the long hole 166 of the inner sheet metal 161 which is pressed into the attaching hole 116 provided above, extends in the horizontal direction (depth direction of the housing 101) in FIG. 9, and the long hole 166 of the inner sheet metal 161 which is pressed into the attaching hole 116 below, extends in the vertical direction (height direction of the housing 101) in FIG. 9. In addition, in the right side wall portion 111, a vertical hole 126 which extends in the height direction of the housing 101 is provided between each of the attaching holes 116 provided below.

Next, with reference to FIG. 10, a configuration of the outer sheet metal 160 which is fastened with the inner sheet metal 161 will be described.

Figure 10:
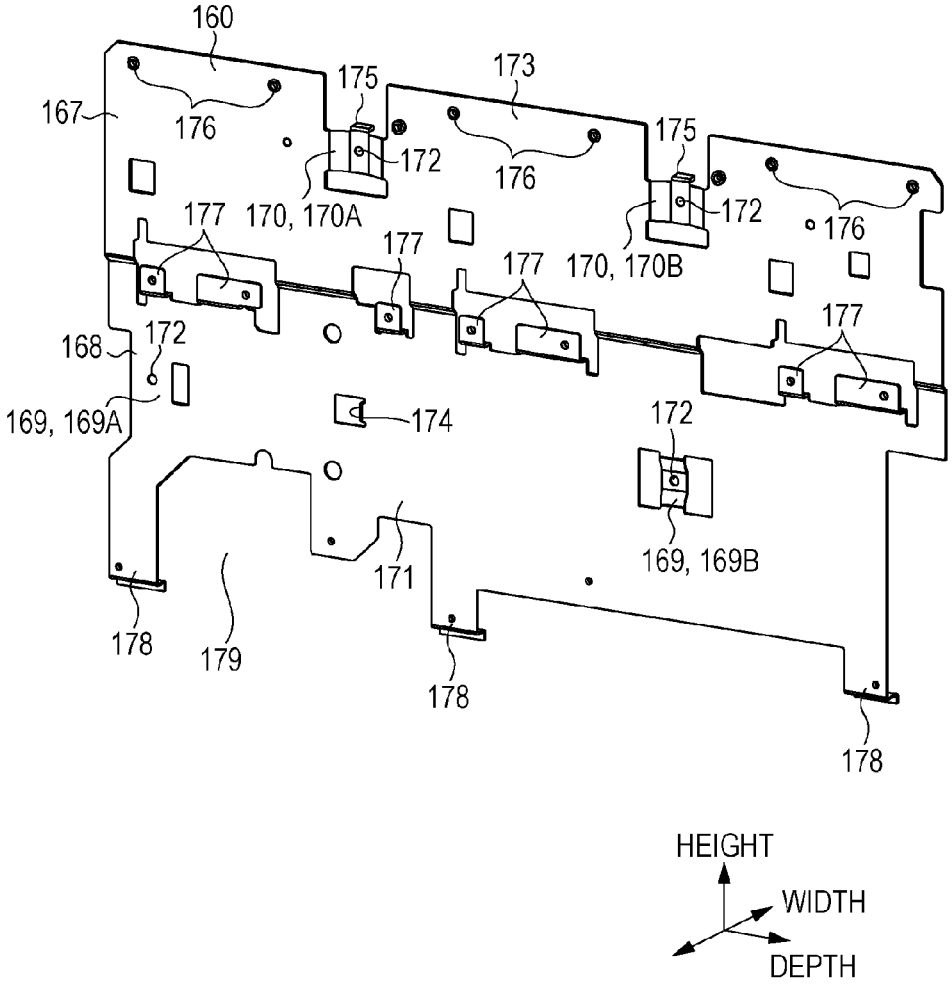
FIG. 10 is a perspective view of an outer sheet metal which is attached to the first liquid storing unit.

As illustrated in FIG. 10, the outer sheet metal 160 includes an upper sheet portion 167 which is positioned at an upper part in the height direction of the printer, and a lower sheet portion 168 which is positioned at a lower part. The upper sheet portion 167 is connected to the lower sheet portion 168 via the step, and the upper sheet portion 167 is positioned on an outer side in the width direction of the printer with respect to the lower sheet portion 168. In the lower sheet portion 168, a fastening portion 169, which is fastened with the inner sheet metal 161 provided below the right side wall portion 111 of the middle housing 110 by the screw, is provided. The fastening portion 169 is aligned in order of a first fastening portion 169A and a second fastening portion 169B from the near side in the depth direction of the printer. In addition, in the upper sheet portion 167, a fastening portion 170, which is fastened with the inner sheet metal 161 provided at an upper part of the right side wall portion 111 of the middle housing 110 by the screw, is provided. The fastening portion 170 is aligned in order of a third fastening portion 170A and a fourth fastening portion 170B from the near side in the depth direction of the printer.

The first fastening portion 169A includes a circular screw hole 172 which is provided on a reference surface 171 of the lower sheet portion 168. In addition, the second fastening portion 169B is protruded to the further inner side in the width direction of the printer than the reference surface 171 of the lower sheet portion 168, and the screw hole 172 is provided on a bottom surface thereof.

Meanwhile, the third fastening portion 170A provided in the upper sheet portion 167 is protruded to the further inner side in the depth direction of the printer than a reference surface 173 of the upper sheet portion 167. In addition, the level of protrusion is the same as the step between the reference surface 171 of the lower sheet portion 168 and the reference surface 173 of the upper sheet portion 167. For this reason, the screw hole 172 which is provided on the bottom surface of the third fastening portion 170A and the screw hole 172 of the first fastening portion 169A, are arranged at a position in a thickness direction of the outer sheet metal 160 which is a direction orthogonal to the reference surface 171 and the reference surface 173.

In addition, the fourth fastening portion 170B is protruded to the further inner side in the width direction of the printer than the reference surface 173 of the upper sheet portion 167. In addition, the level of protrusion is greater than that of the third fastening portion 170A, and the bottom surface of the fourth fastening portion 170B is positioned on the further inner side in the width direction of the printer than the reference surface 171 of the lower sheet portion 168. The screw hole 172 which is provided on the bottom surface of the fourth fastening portion 170B and the screw hole 172 which is provided on the bottom surface of the second fastening portion 169B are arranged at a position in the thickness direction of the outer sheet metal 160.

In addition, between the first fastening portion 169A and the second fastening portion 169B, a protrusion portion 174 which has a shape that extends in the height direction of the printer in accordance with the vertical hole 126 provided in the right side wall portion 111 of the middle housing 110, and which is protruded to the inner side in the width direction of the printer, is provided. In addition, in the third fastening portion 170A and the fourth fastening portion 170B, protrusion portions 175 which have a shape that extends in the width direction of the printer in accordance with the long hole 166 of the inner sheet metal 161 at an upper end thereof, and which is protruded to the inner side in the width direction of the printer, are respectively provided.

In addition, in an upper end portion of the outer sheet metal 160, a plurality of boss portions 176, which are screwed with the screw that penetrates the case 141 when stay 153 is fastened to the inner surface of the case 141 by the screw, is provided. In addition, in an upper end portion of the lower sheet portion 168 of the outer sheet metal 160, a plurality of screw clamp portions 177, which are bent to the outer side in the width direction of the printer, is provided. Meanwhile, in a lower end portion of the lower sheet portion 168, a plurality of insertion portions 178, which are bent to the inner side in the width direction of the printer from the reference surface 171 of the lower sheet portion 168, and in which tip ends thereof extend downward, are provided. At a part on the near side in the depth direction of the printer, a cutout 179 is formed.

Next, with reference to FIG. 11, one example of fastening method of the outer sheet metal 160 and the inner sheet metal 161 will be described.

Figure 11:
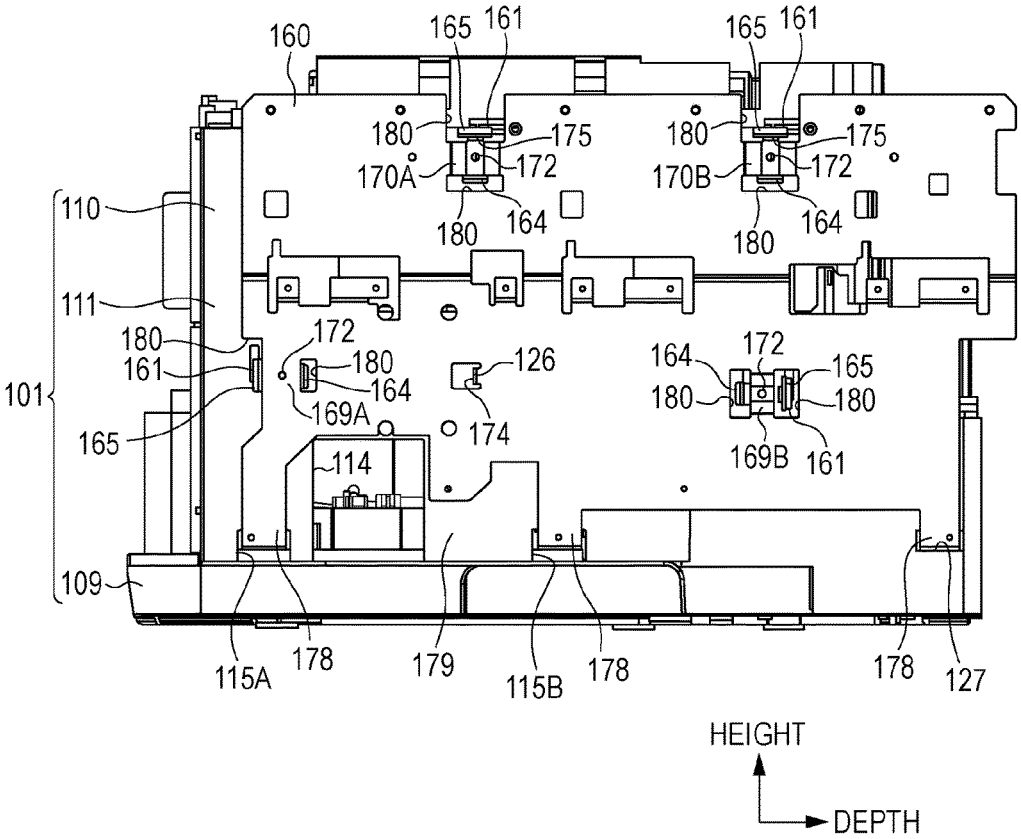
FIG. 11 is a left side view of the middle housing illustrating a state when the inner sheet metal and the outer sheet metal are fastened with each other.

As illustrated in FIG. 11, in a state where a lower end of the middle housing 110 is supported by the base frame 109, first, the plurality of insertion portions 178 provided on a lower end of the outer sheet metal 160 are respectively stuck in the cutout portions 115A and 115B which are provided on the lower end of the right side wall portion 111 of the middle housing 110. In addition, one of the plurality of insertion portions 178 of the outer sheet metal 160 is inserted through a supporting hole 127 provided in the base frame 109. Accordingly, the lower end of the outer sheet metal 160 is supported by the housing 101 from below. Then, the protrusion portions 175 which are provided in the third fastening portion 170A and the fourth fastening portion 170B of the outer sheet metal 160 are inserted through the long holes 166 of the two inner sheet metals 161 provided at the upper part of the right side wall portion 111 of the middle housing 110. Since the inner side hole portion 121 which is provided in the attaching hole 116 of the right side wall portion 111 is overlapped with the long hole 166 of the inner sheet metal 161, the protrusion portion 175 which is inserted through the long hole 166 is also inserted in the inner side hole portion 121 and penetrates the right side wall portion 111 of the middle housing 110.

In addition, the protrusion portion 174 which is provided between the first fastening portion 169A and the second fastening portion 169B of the outer sheet metal 160 is inserted through the vertical hole 126 which is provided in the right side wall portion 111 of the middle housing 110. Since a hole extending direction of the long hole 166 of the inner sheet metal 161 and a hole extending direction of the vertical hole 126 of the right side wall portion 111 are different from each other, as the protrusion portions 174 and 175 are respectively inserted through these holes, it is possible to match the positions of the inner sheet metal 161 and the outer sheet metal 160 with respect to the right side wall portion 111 both in the height direction and the width direction of the printer. By inserting the screws from the outer sheet metal 160 side into each of the screw holes 172 of the first to the fourth fastening portions, the screw inserting hole 125 of the middle housing 110, and the screw hole 162 of the inner sheet metal 161, the inner sheet metal 161 and the outer sheet metal 160 are fastened with each other. When the inner sheet metal 161 and the outer sheet metal 160 are fastened with each other in this manner, the right side wall portion 111 of the middle housing 110 is in a state of being nipped by the outer sheet metal 160 and the inner sheet metal 161.

In addition, tip ends of the first maintaining portion 164 and the second maintaining portion 165 of the inner sheet metal 161 are protruded to the further outer side than the wall surface of the right side wall portion 111. In the outer sheet metal 160, a plurality of hole portions 180 are provided at a part which is overlapped with the tip ends of the first maintaining portion 164 and the second maintaining portion 165 of the inner sheet metal 161. For this reason, in a state where the outer sheet metal 160 and the inner sheet metal 161 are fastened with each other, a tip end of the inner sheet metal 161 is exposed from the hole portion 180 of the outer sheet metal 160.

The cutout 179 which is provided on the lower end of the outer sheet metal 160 in this state, is overlapped with the concave portion 114 of the right side wall portion 111 of the middle housing 110, that is, the tube inserting hole 156 of the case 141. For this reason, when the outer sheet metal 160 and the inner sheet metal 161 are fastened with each other, without covering the tube inserting hole 156 with the outer sheet metal 160, it is possible to introduce the ink supplying tube 154 or the integrated cable into the housing 101 through the cutout 179 and the tube inserting hole 156.

Figure 12:
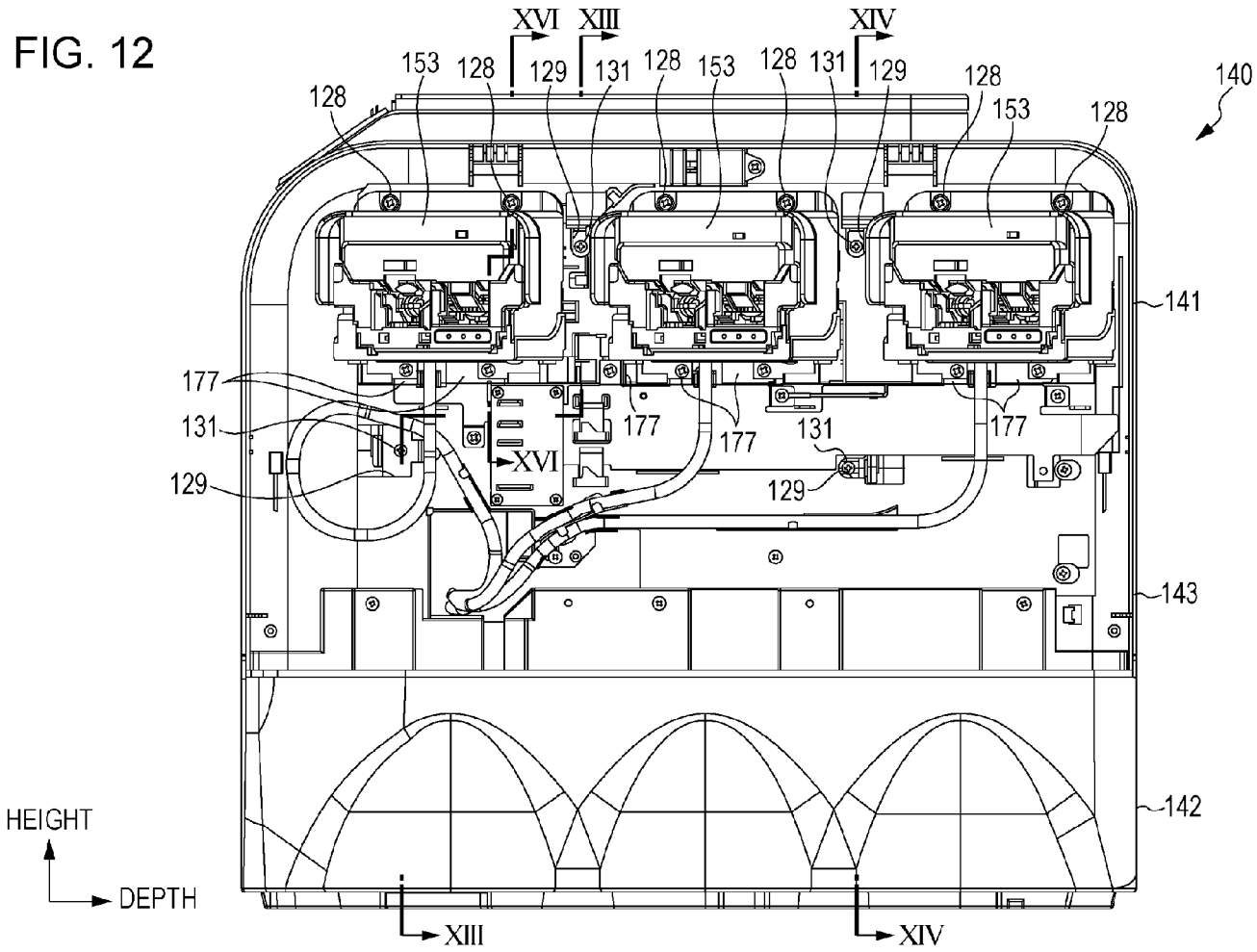
FIG. 12 is a front view of the first liquid storing unit in a state where the lid body and the cover are detached.

As illustrated in FIG. 12, the case 141 of the first liquid storing unit 140 is fastened with the outer sheet metal 160 by the plurality of screws which are inserted through from the outer side of the case 141. In addition, the plurality of stays 153 are fixed to the inner surface of the case 141. A screw 128 which fixes an upper end of the stay 153 to the case 141 is screwed with the boss portion 176 which penetrates the case 141 and is provided in the outer sheet metal 160. For this reason, the screw 128 which fixes an upper end portion of the stay 153 to the case 141 not only fixes the case 141 and the stay 153 to each other, but also fixes the case 141 and the outer sheet metal 160 to each other.

In addition, in the case 141, the hole is opened at a part which opposes a lower end portion of the stay 153, and the screw clamp portion 177 of the outer sheet metal 160 is exposed from this part. The lower end portion of the stay 153 is fastened to the screw clamp portion 177 via the screw.

In this manner, by respectively attaching the inner sheet metal 161 attached to the inner surface of the housing 101 and the outer sheet metal 160 attached to the outer surface of the case 141 of the first liquid storing unit 140, to each other, and by fastening the inner sheet metal 161 and the outer sheet metal 160 with each other, the housing 101 and the case 141 are fixed to each other. For this reason, only as reinforcement is performed by these sheet metals, compared to a case where the housing 101 and the case 141 are directly fastened, strength of the part where the housing 101 and the case 141 are fixed to each other increases. In addition, since the housing 101 and the case 141 are fastened by the screw via the inner sheet metal 161 and the outer sheet metal 160, compared to a case where the housing 101 and the case 141 are directly fastened, a load transferred via the screw is dispersed to a wide range of the housing 101 and the case 141 via each sheet metal.

In addition, in the side wall forming member 143 of the case 141, a cutout hole 129 is formed at a part which is not overlapped with the stay 153. The outer sheet metal 160 and the inner sheet metal 161 are installed so that the screw holes 162 and 172 which are respectively formed are overlapped with the cutout hole 129, and the outer sheet metal 160 and the inner sheet metal 161 are fastened with each other by a screw 131 which is inserted through each of the screw holes 162 and 172 from the outer sheet metal 160 side. For this reason, a head of the screw 131 which fastens the case 141 and the housing 101 with each other is in a state of being exposed through the cutout hole 129 which is provided in the case 141.

In the first liquid storing unit 140 provided in this configuration, even without detaching the stay 153 which is attached to the case 141, it is possible to tighten and untighten the screw 131 which fastens the outer sheet metal 160 and the inner sheet metal 161 with each other from the inside of the case 141. For this reason, only by releasing the fastened outer sheet metal 160 and the inner sheet metal 161, as illustrated in FIG. 4, it is possible to detach the case 141 from the housing 101 in a state of the outer sheet metal 160 is still fixed to the outer surface of the case 141. Therefore, operability when performing maintenance or the like of the recording unit 100 is improved.

Figure 14:
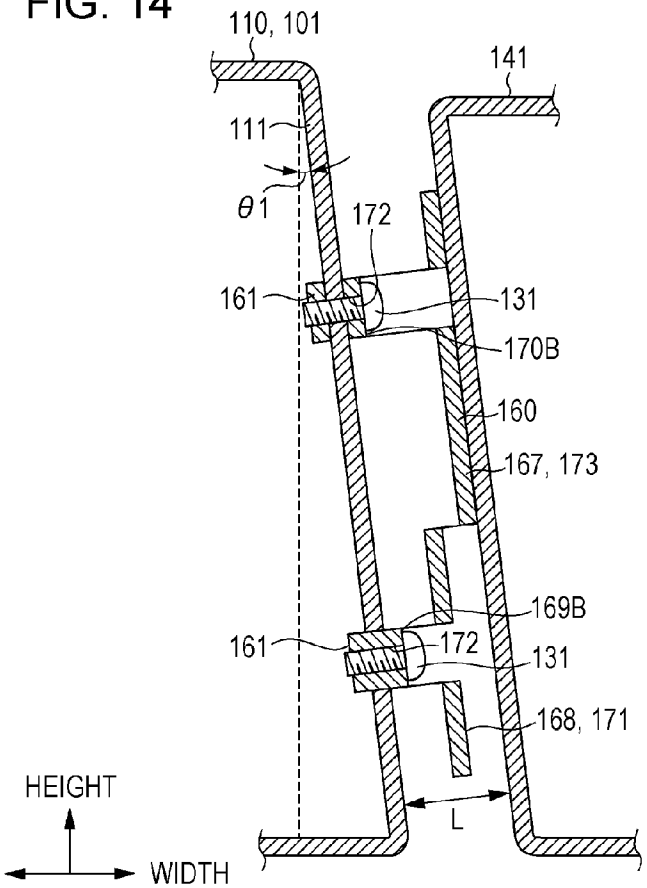
FIG. 14 is a schematic view illustrating a cross section along line XIV-XIV in FIG. 12.
Figure 13:
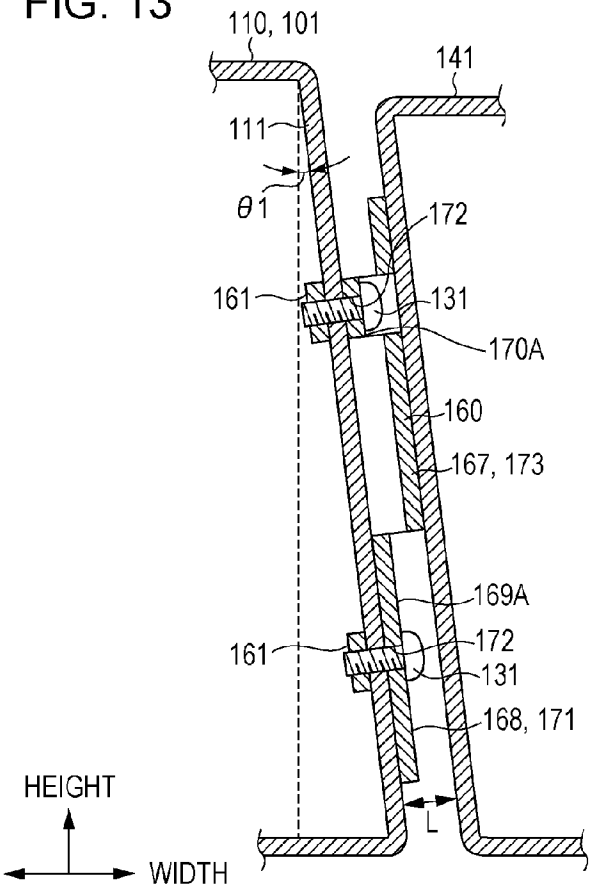
FIG. 13 is a schematic view illustrating a cross section along line XIII-XIII in FIG. 12.

Next, with reference to FIGS. 13 and 14, a structure of a fixing portion of the housing 101 and the case 141 will be described. In addition, FIG. 13 is a schematic view illustrating a cross-sectional structure along a line which links the first fastening portion 169A and the third fastening portion 170A in FIG. 12. FIG. 14 is a schematic view illustrating a cross-sectional structure along a line which links the second fastening portion 169B and the fourth fastening portion 170B in FIG. 12.

As illustrated in FIG. 13, the right side wall portion 111 of the middle housing 110 is inclined at an inclination angle θ1 with respect to the height direction of the printer so as to be positioned on the outer side as approaching a lower part with respect to the height direction of the printer. The inner sheet metal 161 is attached to the right side wall portion 111 from the inner side of the housing 101. In other words, the inner sheet metal 161 is attached to the inner surface of the middle housing 110.

In addition, since the first fastening portion 169A in the outer sheet metal 160 is provided on the reference surface 171 of the lower sheet portion 168, the lower sheet portion 168 of the outer sheet metal 160 abuts against an outer surface of the middle housing 110, and is fastened by the screw 131 in a state of being apart from the outer surface of the case 141. The upper sheet portion 167 which is connected to the lower sheet portion 168 is positioned on the further outer side than the lower sheet portion 168 in the width direction of the printer. For this reason, the upper sheet portion 167 is apart from the outer surface of the middle housing 110, and abuts against the outer surface of the case 141. The third fastening portion 170A is protruded to the middle housing 110 side from the upper sheet portion 167, and is fastened by the inner sheet metal 161 and the screw 131 in a state where the bottom surface thereof abuts against the outer surface of the middle housing 110. As described above, the level of protrusion of the third fastening portion 170A from the reference surface 173 is the same as the step between the reference surface 171 and the reference surface 173, and the screw hole 172 which is provided on the bottom surface of the third fastening portion 170A and the screw hole 172 of the first fastening portion 169A are arranged at a position in the thickness direction of the outer sheet metal 160. For this reason, the distances from the outer surface of the case 141 which abuts against the upper sheet portion 167 to the first fastening portion 169A and the third fastening portion 170A are equivalent to each other. Therefore, the case 141 of the first liquid storing unit 140 is mounted on the housing 101 in a state of being inclined at an equivalent angle to the inclination angle θ1 with respect to the height direction of the printer to be along the right side surface of the housing 101 which is inclined with respect to the height direction of the printer.

Figure 15:
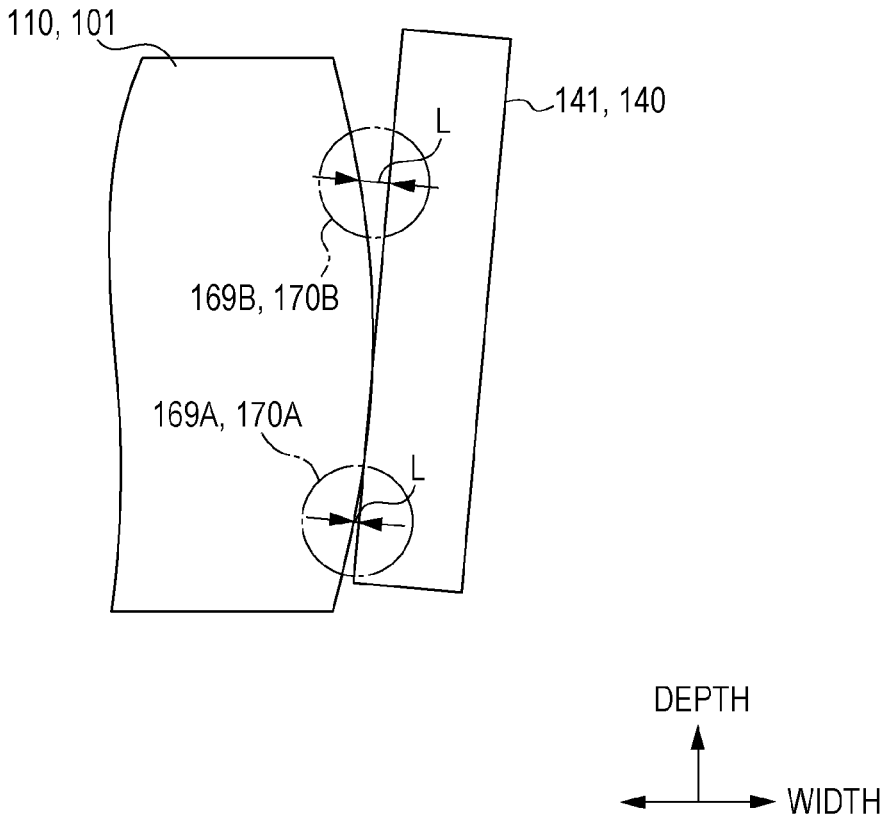
FIG. 15 is a schematic view illustrating a state of the middle housing and the first liquid storing unit when the recording apparatus is viewed from above.

Meanwhile, as illustrated in FIG. 14, at a part where the second fastening portion 169B is provided, since the second fastening portion 169B is positioned on the further inner side in the width direction of the printer than the reference surface 171 of the lower sheet portion 168, the lower sheet portion 168 is in a state of being apart from the outer surface of the middle housing 110. In addition, as described above, the level of the protrusion of the fourth fastening portion 170B from the reference surface 173 is greater than the level of protrusion of the third fastening portion 170A, and the screw hole 172 which is provided on the bottom surface of the fourth fastening portion 170B and the screw hole 172 which is provided on the bottom surface of the second fastening portion 169B, are arranged at a position in the thickness direction of the outer sheet metal 160. Therefore, as illustrated in FIG. 15, compared to a part which is provided with the first fastening portion 169A and the third fastening portion 170A, at the part which is provided with the second fastening portion 169B and the fourth fastening portion 170B, a distance L from the housing 101 to the case 141 becomes longer. In other words, the case 141 is mounted on the housing 101 in a state of being inclined with respect to the depth direction of the printer so that the outer surface of the case 141 is positioned on the inner side of the printer in the width direction as approaching to the near side in the depth direction of the printer. In this manner, since the distance L from the outer surface of the case 141 to the right side surface of the housing 101 on which the case 141 is mounted becomes shorter as approaching the near side in the depth direction of the printer, compared to a case where the case 141 is mounted without inclination with respect to the depth direction of the printer, a void between the housing 101 and the case 141 when viewed from the front surface becomes smaller.

In addition, since the case 141 has a shape of a substantially rectangular parallelepiped, when the case 141 is inclined with respect to the depth direction of the printer as described above, the width of the printer including the case 141 becomes wider as approaching the far side in the depth direction of the printer. For this reason, a side wall of the printer is recognized as recessed when viewed from the front surface.

Figure 16:
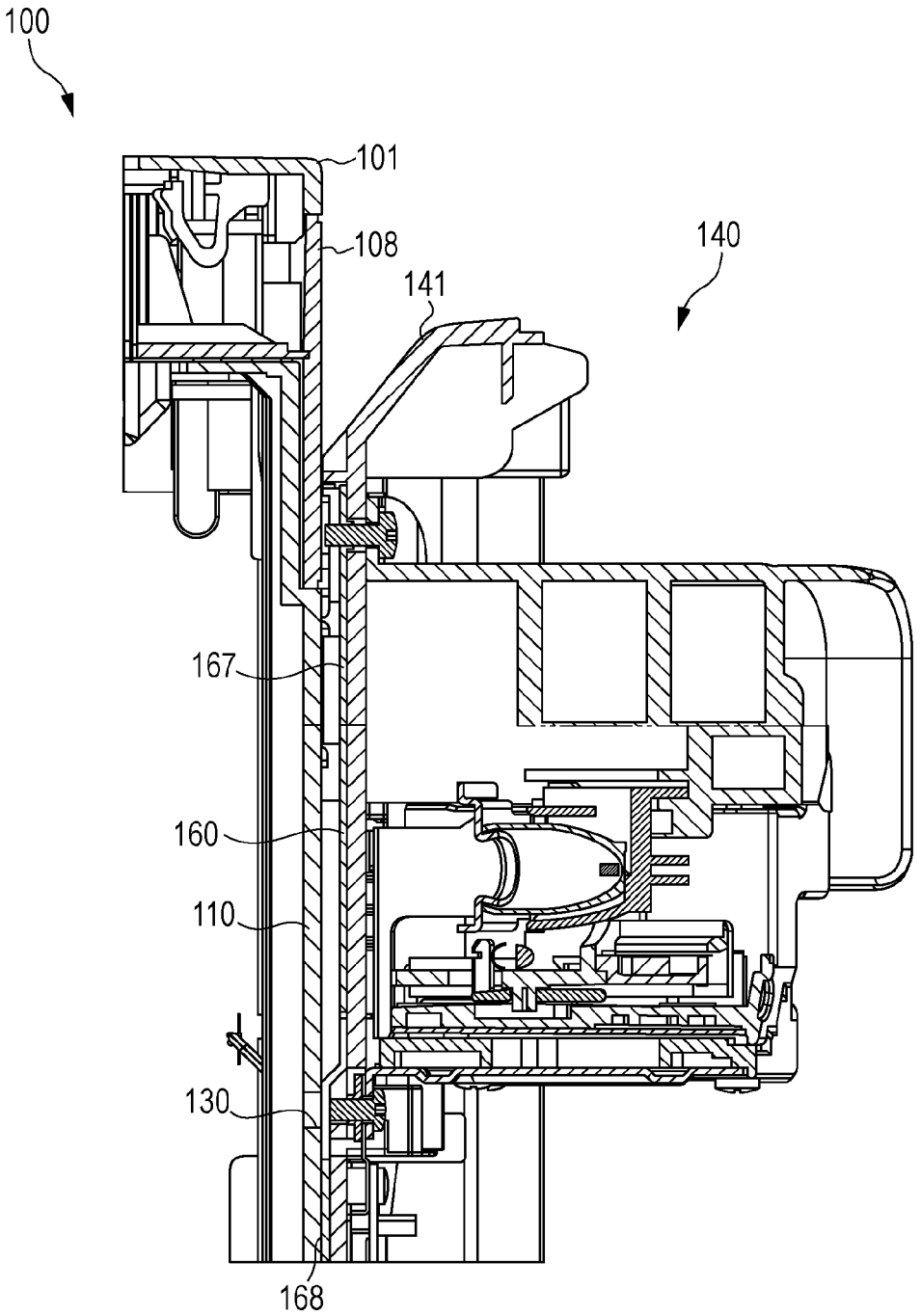
FIG. 16 is a cross-sectional view along line XVI-XVI in FIG. 12.

In addition, as illustrated in FIG. 16, the scanner portion 108 which is provided at the upper part of housing 101, and the outer sheet metal 160 which is attached to the outer surface of the case 141, oppose each other, but since the upper sheet portion 167 of the outer sheet metal 160 is provided to be bent to the case 141 side, a gap between the scanner portion 108 and the outer sheet metal 160 is provided.

If the outer sheet metal 160 abuts against the wall surface of the housing 101, when fastening the outer sheet metal 160 and the case 141 by the screw from the inner side of the case 141, the screw which penetrates the outer sheet metal 160 interferes with the wall surface of the housing 101. In this regard, in the embodiment, a release hole 130 is provided on the wall surface of the middle housing 110. For this reason, even when the case 141 is fastened to the lower sheet portion 168 of the outer sheet metal 160 which abuts against the wall surface of the middle housing 110 by the screw, the screw does not interfere with the wall surface of the middle housing 110.

Meanwhile, since there is a void between the scanner portion 108 and the outer sheet metal 160, even when the case 141 and the outer sheet metal 160 are fastened by the screw, the tip end of the screw is unlikely to interfere with the wall surface of the scanner portion 108. For this reason, the release hole 130 is not provided on the wall surface of the scanner portion 108.

Next, the second liquid storing unit 190 which is attached to the left side surface of the housing 101 will be described.

As illustrated in FIGS. 1 and 4, the second liquid storing unit 190 includes the first liquid storing unit 140 and a case 191 which is similarly made of resin. The case 191 is configured of a bottom forming member 192 which has a shape of a bottomed box and forms a bottom of the case 191, a side wall forming member 193 which is linked to an upper end of a side wall which opposes the housing 101 in the bottom forming member 192, and a lid body 194 which is rotatably linked to an upper end of the bottom forming member 192. The lid body 194 abuts against an upper end of the side wall forming member 193, and opens/closes the case 191 by being apart. In addition, the case 191 is formed in a shape of a substantially rectangular parallelepiped.

In the case 191, the liquid storing body is accommodated. The liquid storing body stores, for example, black ink, and includes an ink bag which is made of a flexible material and has a greater capacity than the liquid storing body 150 which is provided in the first liquid storing unit 140, and a handle portion which has a rectangular annular shape and is fixed to an upper end portion of the ink bag.

Figure 17:
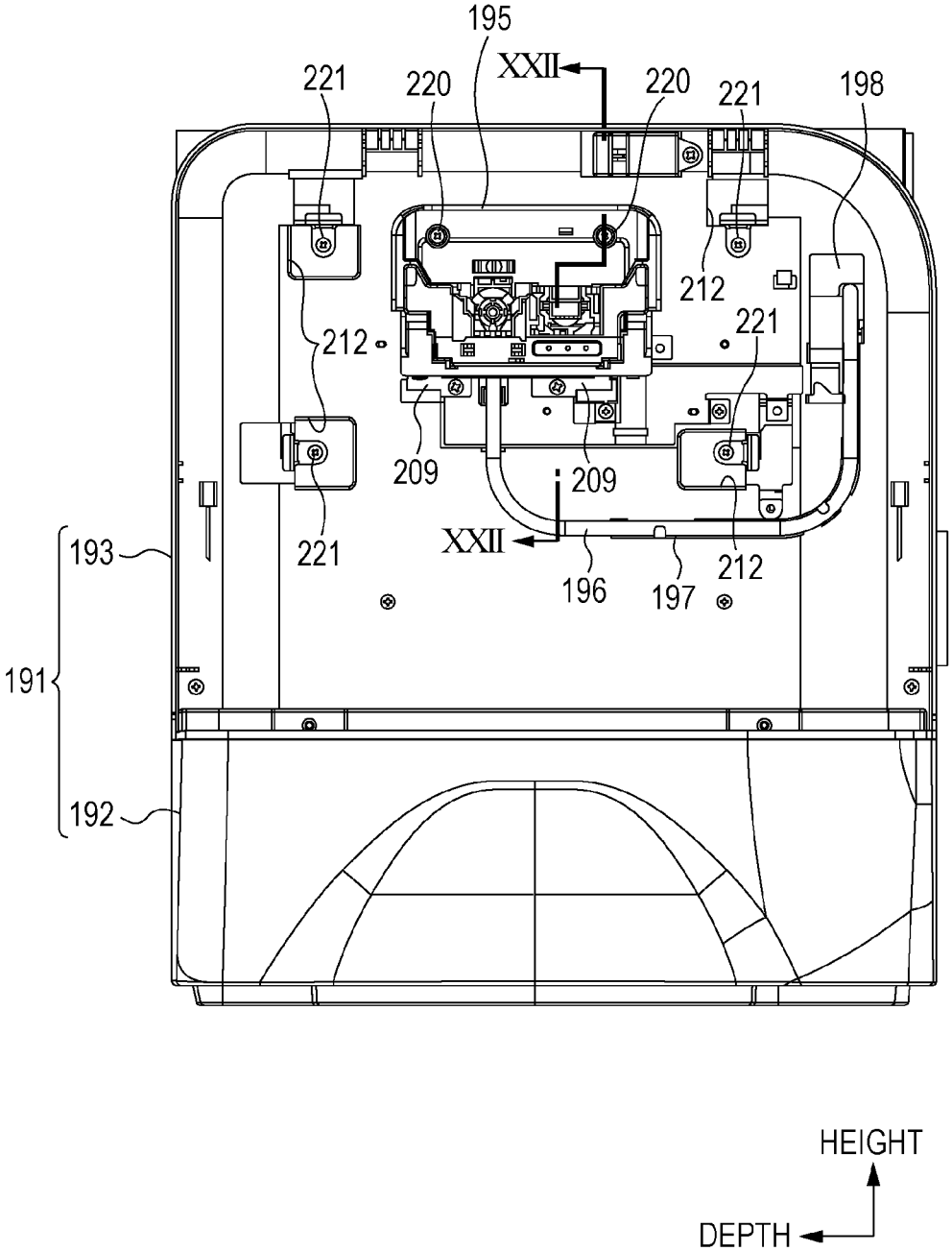
FIG. 17 is a front view of a second liquid storing unit in a state where the lid body and the cover are detached.

As illustrated in FIG. 17, one stay 195 to which the liquid storing body is attached, is fixed to a wall surface of the side wall forming member 193 on an inner side of the case 191. As the handle portion of the liquid storing body is fitted into this stay 195, the liquid storing body is attachably and detachably attached. In other words, the stay 195 functions as a liquid storing body maintaining portion which maintains the liquid storing body. In addition, an ink supplying tube 196 is connected to the stay 195. The ink supplying tube 196 is supported in a curved shape by a clamp 197 which is provided on an inner surface of the case 191, and is drawn to the outside of the case 191 through a tube inserting hole 198 which is provided on a near side in the depth direction of the printer in the side wall forming member 193. In addition, a cover, which hides the ink supplying tube 196 that is drawn to the inside of the case 191, is attached to the inside of the case 191, but FIG. 17 illustrates a state where the cover and the lid body 194 are detached.

The ink supplying tube 196 which is drawn to the outside of the case 191 is introduced into the housing 101 of the recording unit 100. For this reason, when the liquid storing body is attached to the stay 195, the ink which is stored in the liquid storing body is supplied to the recording unit 100 via the ink supplying tube 196. The ink which is supplied to the recording unit 100 is supplied to the liquid ejecting head 102 through the ink supply system which is provided in the recording unit 100, and is ejected from the liquid ejecting head 102.

In addition, one ends of an individual cable which is a flexible flat cable is connected to the stay 195. The individual cable is drawn to the outside of the case 191 through the tube inserting hole 198 which is provided in the case 191, and is introduced into the housing 101 of the recording unit 100 outside the case 191. The individual cable which is introduced into the recording unit 100 is connected to the main substrate via the information transfer system which is provided inside the housing 101.

Even in the handle portion of the liquid storing body attached to the stay 195, an IC chip, in which information, such as a residue or a type of the ink stored in the ink bag, is stored, is provided. For this reason, when the liquid storing body is attached to the stay 195, the IC chip and the main substrate are electrically connected to each other. The main substrate performs various controls of the printer based on the information stored in the IC chip. In addition, when the residue of the ink which is stored in the liquid storing body provided in the second liquid storing unit 190, is equal to or less than a predetermined amount, the main substrate outputs a signal urging an exchange of the liquid storing body.

Similarly to the first liquid storing unit 140, the second liquid storing unit 190 is mounted on the housing 101, by fastening an outer sheet metal 199 (refer to FIG. 20) which is attached to an outer surface of the case 191, and the inner sheet metal 161 which is attached from the inner side to the left side surface of the housing 101 by the screw. In addition, the inner sheet metal 161 which is attached to the left side surface of the housing 101 is the same as the inner sheet metal 161 which is attached to the right side surface of the housing 101. In addition, as described above, the left side wall portion 112 of the middle housing 110 which constitutes the housing 101 of the recording unit 100, is exposed to the outside in a state of being assembled to the printer, and the second liquid storing unit 190 is mounted on the wall surface of the left side wall portion 112.

Figure 18:
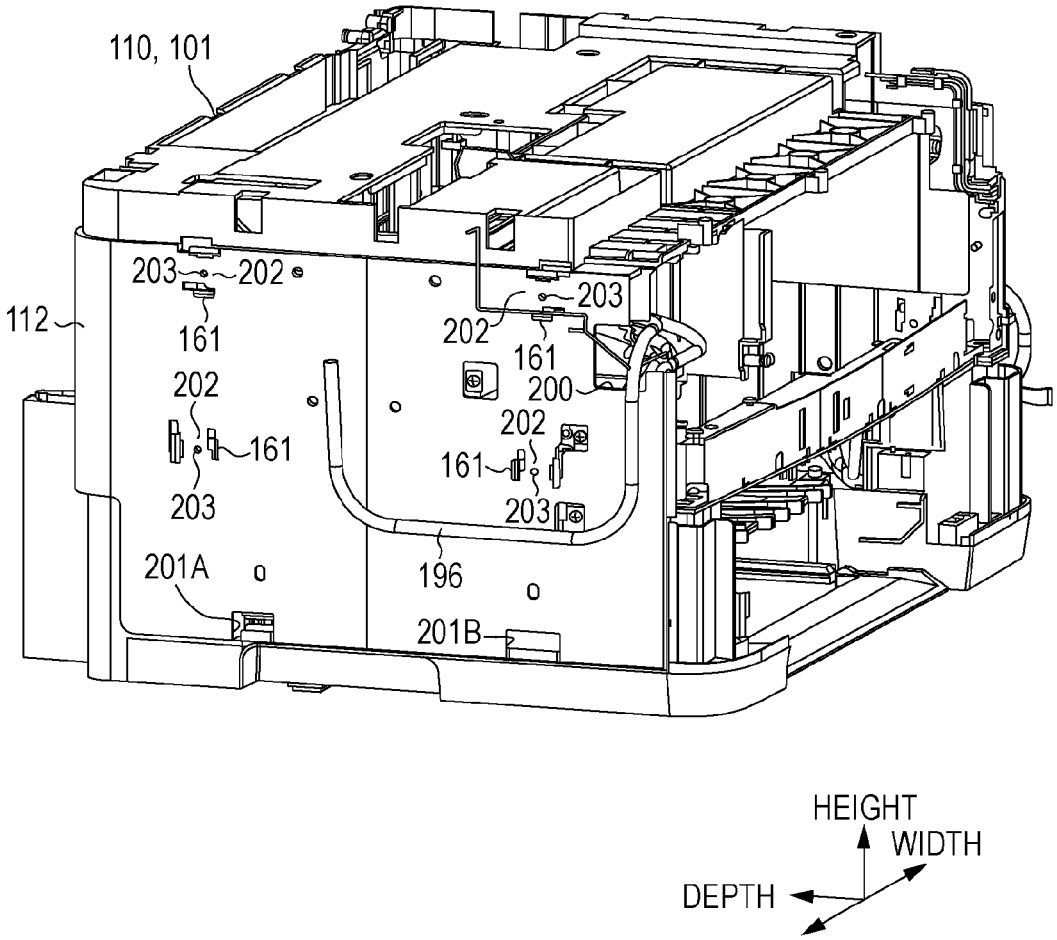
FIG. 18 is a perspective view of the middle housing.

As illustrated in FIG. 18, in the left side wall portion 112 of the middle housing 110, a concave portion 200 which is cut out from the near side in the depth direction of the printer, is provided. The concave portion 200 is provided at a position which opposes the tube inserting hole 198 which is provided in the case 191 of the second liquid storing unit 190. For this reason, the ink supplying tube 196 and the individual cable which are drawn to the outside of the case 191 through the tube inserting hole 198, are guided into the housing 101 through the concave portion 200 which is provided in the left side wall portion 112 of the middle housing 110.

In addition, two cutout portions 201A and 201B which are cut out from the lower end are formed in the left side wall portion 112.

Similarly to the right side wall portion 111, in the depth direction of the printer, the left side wall portion 112 of the middle housing 110 is also formed in a slightly curved shape, so that the length of the printer in the width direction becomes shorter as approaching the near side and the far side, that is, so that the center part is protruded to the outer side in the width direction of the printer. In addition, the left side wall portion 112 is formed in a slightly inclined shape with respect to the height direction of the printer so that the left side wall portion 112 is disposed on the outer side as approaching the lower part of the printer in the height direction, that is, so that the length of the printer in the width direction becomes longer.

In the left side wall portion 112 which is formed in this shape, an attaching hole 202, which has the same shape as that of the attaching hole 116 provided in the right side wall portion 111, is provided. In addition, four attaching holes 202 are formed at four locations including two locations above and two locations below. In addition, a screw inserting hole 203 in a substantially circular shape is similarly provided. The inner sheet metal 161 is pressed into these attaching holes 202 in the same manner as that described above, for example. For this reason, in a state where the inner sheet metal 161 is pressed into the attaching holes 202, the screw hole 162 which is provided in the inner sheet metal 161 and the screw inserting hole 203 which is provided in the left side wall portion 112 are overlapped with each other, and the long hole 166 of the inner sheet metal 161 and the inner side hole portion 121 of the attaching hole 202 are overlapped with each other.

FIG. 18 illustrates a state after the inner sheet metals 161 are attached to all of the attaching holes 202 of the left side wall portion 112. As illustrated in FIG. 18, two attaching holes 202 which are provided above, are provided with a different orientation from each of the attaching holes 202 which are provided below. For this reason, the inner sheet metal 161 which is pressed into the attaching hole 202 provided above, among the inner sheet metals 161 which are attached to the left side wall portion 112, has a different orientation in which the long hole 166 extends from that of other inner sheet metals 161. More specifically, the long hole 166 of the inner sheet metal 161 which is pressed into the attaching hole 202 provided above, extends in the horizontal direction (depth direction of the housing 101) in FIG. 18, and the long hole 166 of the inner sheet metal 161 which is pressed into the attaching hole 202 provided below, extends in the vertical direction (height direction of the housing 101) in FIG. 18.

Figure 19:
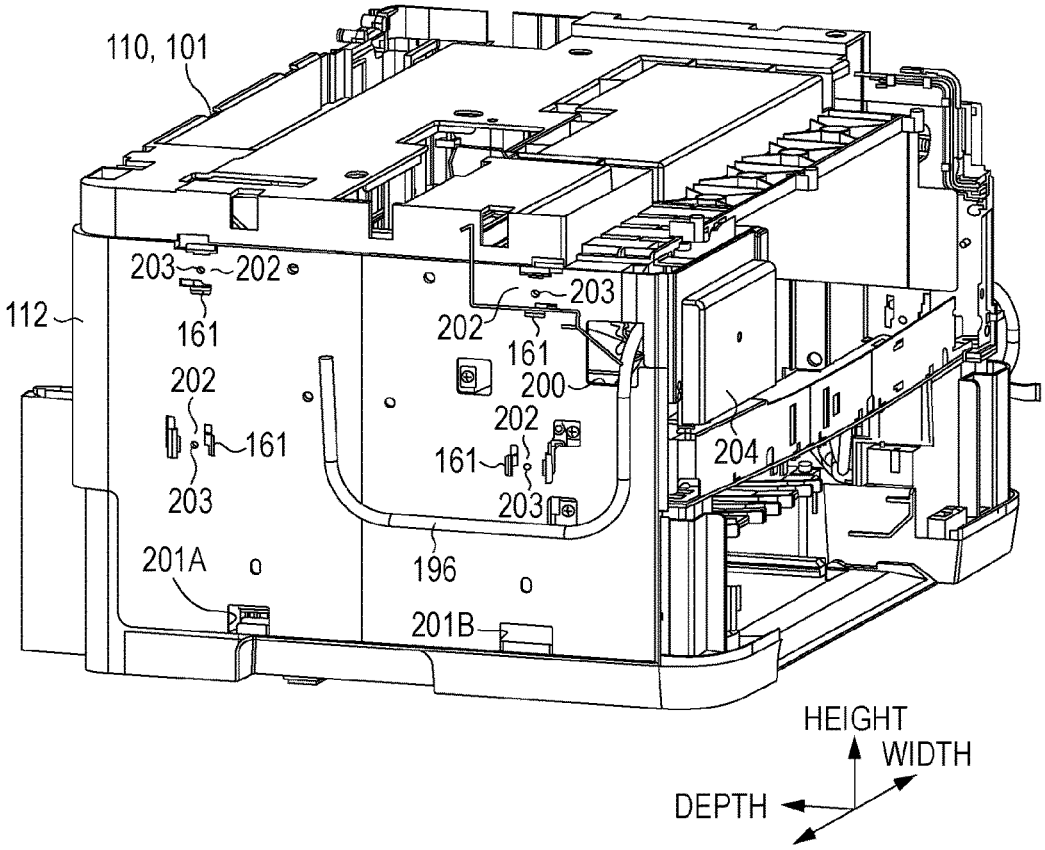
FIG. 19 is a perspective view of the middle housing to which a cover member is attached.

In addition, as illustrated in FIG. 19, when the housing 101 is viewed from the front surface, a cover member 204, which hides a part on the left side surface side into which the ink supplying tube 196 is inserted in the recording unit 100, is attached to the middle housing 110. The cover member 204 constitutes a part of the left side surface of the housing 101, and an opening of the concave portion 200 which is provided in the left side wall portion 112 of the middle housing 110 is blocked by the cover member 204.

Next, with reference to FIG. 20, a configuration of the outer sheet metal 199 of the second liquid storing unit 190 which is fastened with the inner sheet metal 161 pressed into the left side wall portion 112, will be described.

Figure 20:
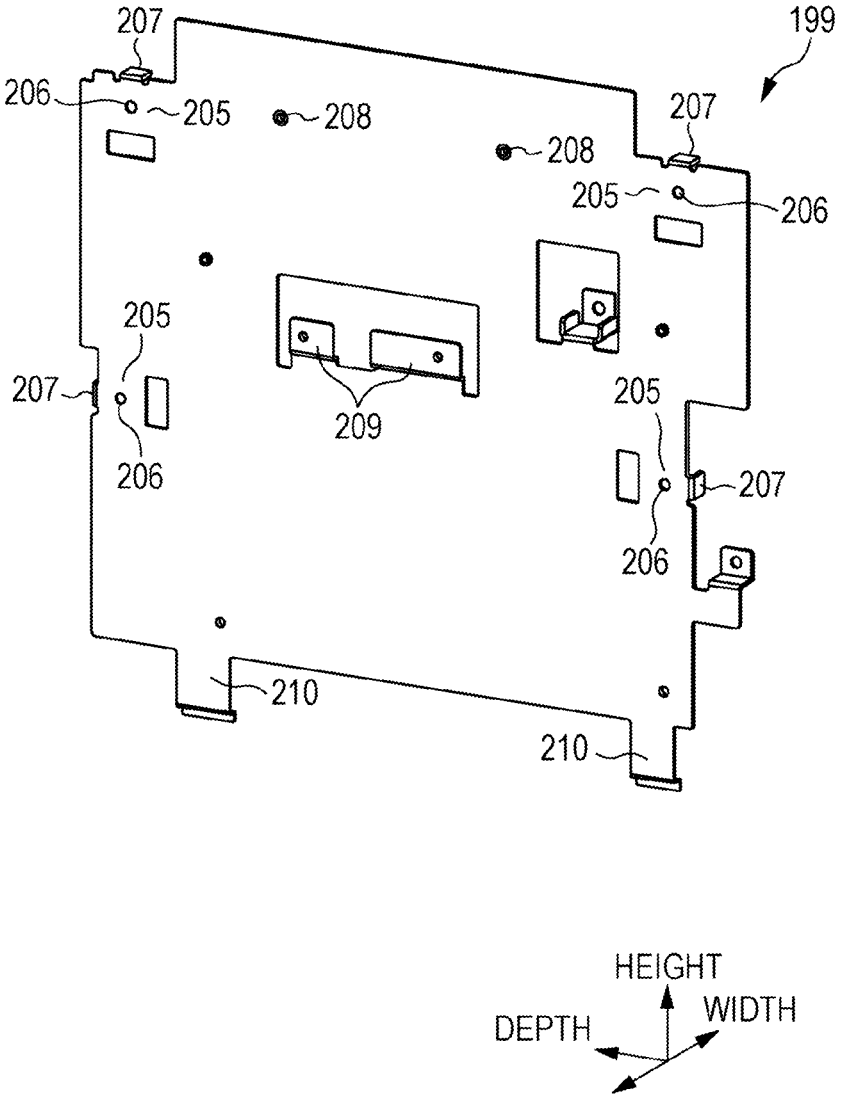
FIG. 20 is a perspective view of the outer sheet metal which is attached to the second liquid storing unit.

As illustrated in FIG. 20, the outer sheet metal 199 of the second liquid storing unit 190 is different from the outer sheet metal 160 of the first liquid storing unit 140, and a step is not provided between a part on the upper side and a part on the lower side. In the outer sheet metal 199, at a position which opposes four inner sheet metals 161 which are provided in the left side wall portion 112 of the middle housing 110, four fastening portions 205 are provided. In these fastening portions 205, circular screw holes 206 are respectively provided. In addition, in end portions of each of the fastening portions 205, and protrusion portions 207 which have a shape that corresponds to the long hole 166 of the inner sheet metal 161 and are protruded to the inner side in the width direction of the printer are respectively provided.

In an upper end portion of the outer sheet metal 199, two boss portions 208, which penetrate the case 191 and are screwed with the screw when fastening the stay 195 by the screw to the inner surface of the case 191, are provided. In addition, in a center portion of the outer sheet metal 199, two screw clamp portions 209, which are bent to the outer side in the width direction of the printer, are provided. Meanwhile, in a lower end portion of the outer sheet metal 199, two insertion portions 210, which are bent to the inner side in the width direction of the printer, and in which tip ends extend downward, are provided.

Next, with respect to FIG. 21, an example of a fastening method of the inner sheet metal 161 which is pressed into the left side wall portion 112 of the middle housing 110 and the outer sheet metal 199 of the second liquid storing unit 190, will be described.

Figure 21:
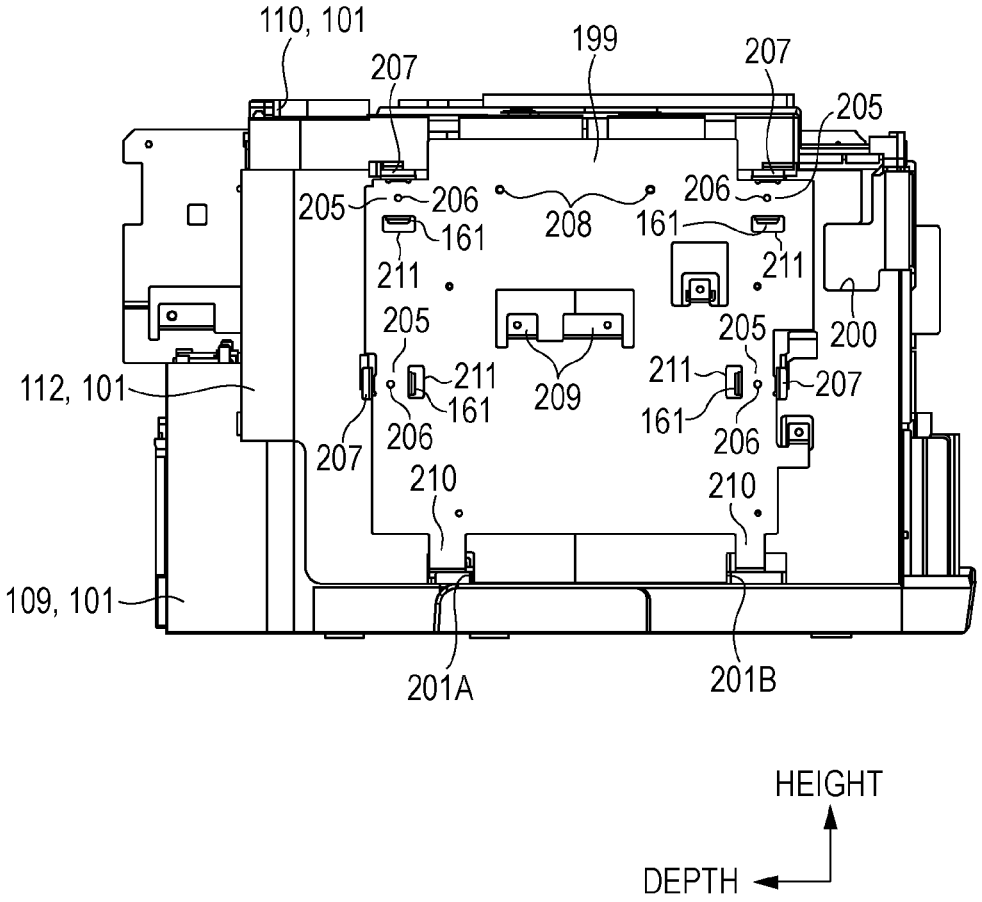
FIG. 21 is a left side view of the middle housing illustrating a state when the inner sheet metal and the outer sheet metal are fastened with each other.

As illustrated in FIG. 21, in a state where the lower end of the middle housing 110 is supported by the base frame 109, first, two insertion portions 210 which are provided at the lower end of the outer sheet metal 199 are respectively stuck in the cutout portions 201A and 201B which are provided at the lower end of the left side wall portion 112 of the middle housing 110. Accordingly, the lower end of the outer sheet metal 199 is supported by the housing 101 from below. Then, the protrusion portions 207 which are provided in the each of the fastening portions 205 of the outer sheet metal 199 are inserted through the long holes 166 of the two inner sheet metals 161. Since the inner side hole portion 121 which is provided in the attaching hole 202 of the left side wall portion 112 is overlapped with the long hole 166 of the inner sheet metal 161, the protrusion portion 207 which is inserted through the long hole 166 in this manner is inserted in the inner side hole portion 121 and penetrates the left side wall portion 112 of the middle housing 110.

In addition, a direction in which the long hole 166 of the inner sheet metal 161 which is pressed into the attaching hole 202 at an upper part of the left side wall portion 112 extends, is different from a direction in which the long holes 166 of the inner sheet metal 161 which are pressed into the attaching holes 202 at a lower part extends. For this reason, by inserting the protrusion portion 207 through these long holes 166, it is possible to match the positions of the inner sheet metal 161 and the outer sheet metal 199 with respect to the left side wall portion 112 both in the height direction and the width direction of the printer. Then, the inner sheet metal 161 and the outer sheet metal 199 are fastened with each other by inserting the screw from the outer sheet metal 199 side to the screw holes 206 of each of the fastening portions 205, the screw inserting hole 203 of the middle housing 110, and the screw hole 162 of the inner sheet metal 161. When the inner sheet metal 161 and the outer sheet metal 199 are fastened with each other in this manner, the left side wall portion 112 of the middle housing 110 is in a state of being nipped by the outer sheet metal 199 and the inner sheet metal 161.

In addition, the tip end of the inner sheet metal 161 is protruded to a further outer side than the wall surface of the left side wall portion 112. A plurality of hole portions 211 are provided at a part which is overlapped with the tip end of the inner sheet metal 161 in the outer sheet metal 199. For this reason, in a state where the outer sheet metal 199 and the inner sheet metal 161 are fastened with each other, the tip end of the inner sheet metal 161 is exposed from the hole portion 211 of the outer sheet metal 199.

In addition, in a state where the inner sheet metal 161 and the outer sheet metal 199 are fastened with each other, since the outer sheet metal 199 does not reach the concave portion 200 of the left side wall portion 112, the concave portion 200 is not covered with the outer sheet metal 199, and when introducing the ink supplying tube 196 or the individual cable into the housing 101, the outer sheet metal 199 does not become an obstacle.

As illustrated in FIG. 17, the case 191 of the second liquid storing unit 190 is fastened with the outer sheet metal 199 by the plurality of screws which are inserted from the inside of the case 191. In addition, the stay 195 is fixed to the inner surface of the case 191. A screw 220 which is fixed to the case 191 of the stay 195 is screwed with the boss portion 208 which penetrates the case 191 and is provided in the outer sheet metal 199. For this reason, the screw 220 which fixes an upper end portion of the stay 195 to the case 191, fixes not only the case 191 and the stay 195 to each other, but also the case 191 and the outer sheet metal 199 to each other.

In addition, in the case 191, a hole is opened at a part which opposes a lower end portion of the stay 195, and the screw clamp portion 209 of the outer sheet metal 199 is exposed from this part. The lower end portion of the stay 195 is fastened to the screw clamp portion 209 by the screw.

In this manner, by respectively attaching the inner sheet metal 161 attached to the inner surface of the housing 101 and the outer sheet metal 199 attached to the outer surface of the case 191 of the second liquid storing unit 190, to each other, and by fastening the inner sheet metal 161 and the outer sheet metal 199 with each other, the housing 101 and the case 191 are fixed to each other. For this reason, only as reinforcement is performed by these sheet metals, compared to a case where the housing 101 and the case 191 are directly fastened, strength of the part where the housing 101 and the case 191 are fixed to each other increases. In addition, since the housing 101 and the case 191 are fastened by the screw via the inner sheet metal 161 and the outer sheet metal 199, compared to a case where the housing 101 and the case 191 are directly fastened, a load transferred via the screw is dispersed to a wide range of the housing 101 and the case 191 via each sheet metal.

In addition, in the side wall forming member 193 of the case 191, a cutout hole 212 is formed at a part which is not overlapped with the stay 195. The outer sheet metal 199 and the inner sheet metal 161 are installed so that the screw holes 206 and 162 which are respectively formed are overlapped with the cutout hole 212, and the outer sheet metal 199 and the inner sheet metal 161 are fastened with each other by a screw 221 which is inserted through each of the screw holes 206 and 162 from the outer sheet metal 199 side. For this reason, a head of the screw 221 which fastens the case 191 and the housing 101 is in a state of being exposed through the cutout hole 212 which is provided in the case 191.

In the second liquid storing unit 190 provided with this configuration, even without detaching the stay 195 which is attached to the case 191, it is possible to tighten and untighten the screw 221 which fastens the outer sheet metal 199 and the inner sheet metal 161 from the inside of the case 191. For this reason, only by releasing the fastened outer sheet metal 199 and the inner sheet metal 161, it is possible to detach the case 191 from the housing 101 in a state where the outer sheet metal 199 is still fixed to the outer surface of the case 191. Therefore, operability when performing maintenance or the like of the recording unit 100 is improved.

Figure 22:
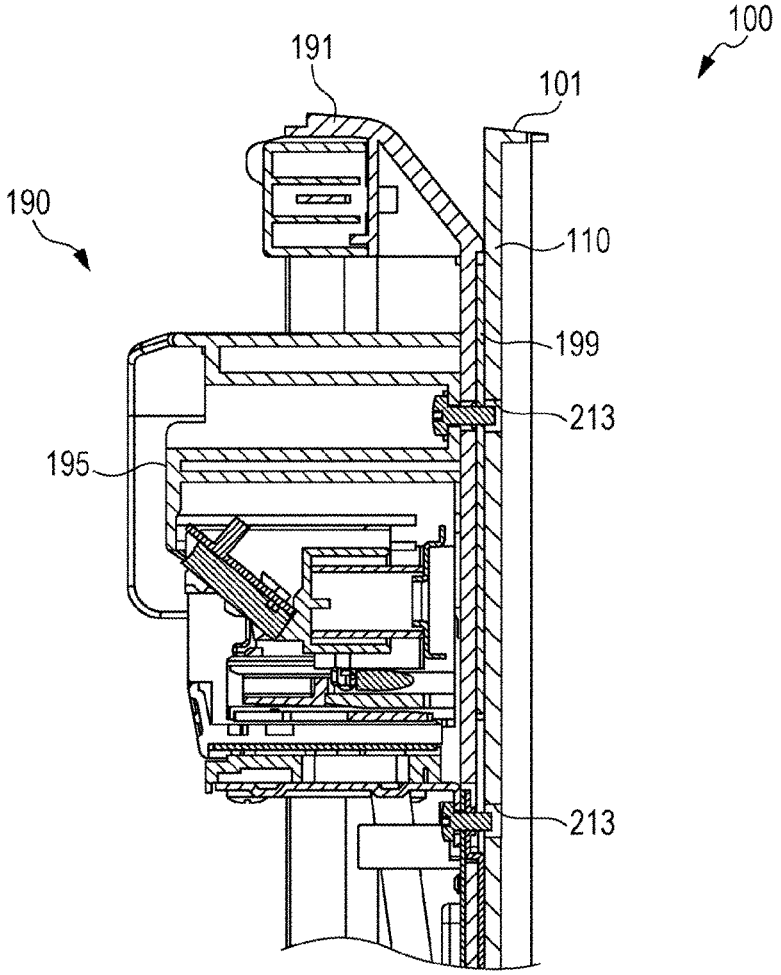
FIG. 22 is a cross-sectional view along line XXII-XXII in FIG. 17.

In addition, as illustrated in FIG. 22, substantially the entire outer surface of the case 191 of the second liquid storing unit 190 abuts against the outer sheet metal 199, and substantially entire surface of the housing 101 also abuts against the outer sheet metal 199. For this reason, a release hole 213 is provided on the wall surface of the middle housing 110, and the screw which penetrates the outer sheet metal 199 does not interfere with the wall surface of the middle housing 110 when fastening the case 191 and the outer sheet metal 199 by the screw which is inserted from the inner side of the case 191.

In addition, the left side wall portion 112 of the middle housing 110 is inclined with respect to the height direction of the printer to be positioned on a further outer side as approaching the lower part with respect to the height direction of the printer. For this reason, the second liquid storing unit 190 which is mounted along the left side wall portion 112 is mounted on the housing 101 in a state of being inclined with respect to the height direction of the printer at the equivalent angle to the inclination angle of the left side wall portion 112.

Figure 23:
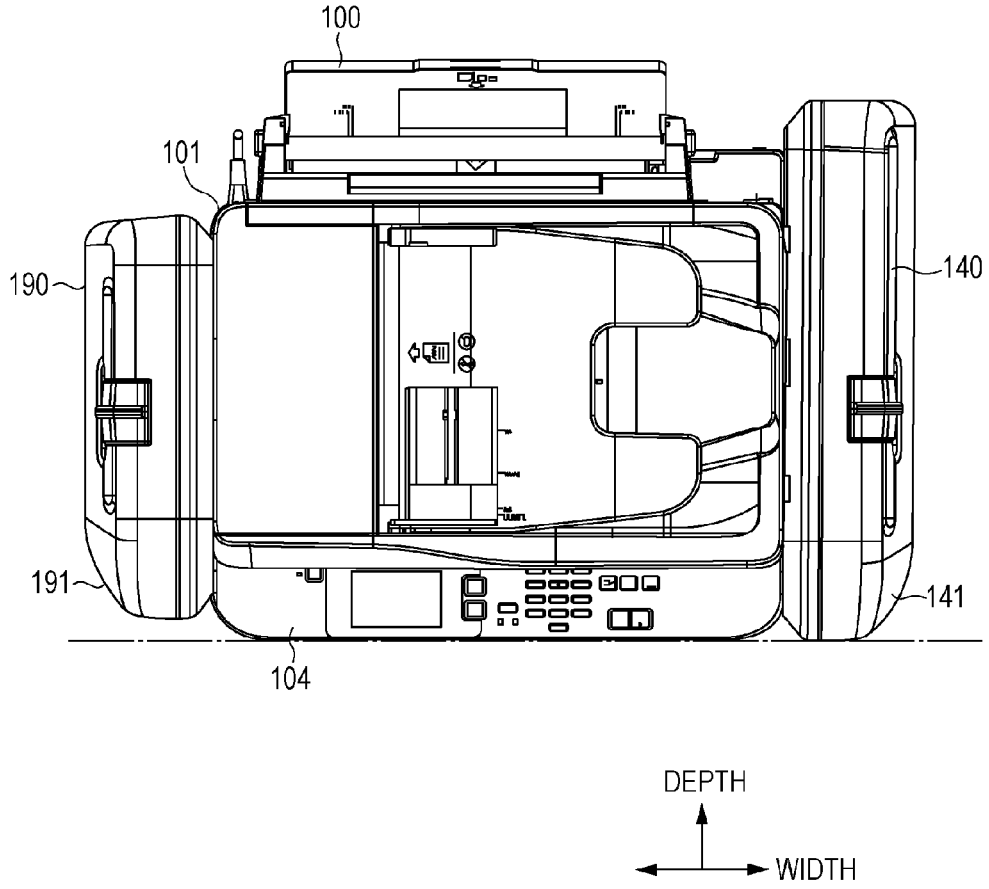
FIG. 23 is an upper view of the recording apparatus.

However, as illustrated in FIG. 23, the length of the second liquid storing unit 190 in the depth direction of the printer is shorter than that of the first liquid storing unit 140. In the embodiment, the case 191 of the second liquid storing unit 190 is mounted on the left side surface of the housing 101 without inclination with respect to the depth direction of the printer.

In addition, as illustrated in FIG. 23, in the depth direction of the printer, the first liquid storing unit 140 and the second liquid storing unit 190 are positioned on a further side than the part on the nearest side of the housing 101. For this reason, the cases 141 and 191 do not become a more projected shape on the near side than the housing 101, the cases 141 and 191 are unlikely to become obstacles.

Figure 24:
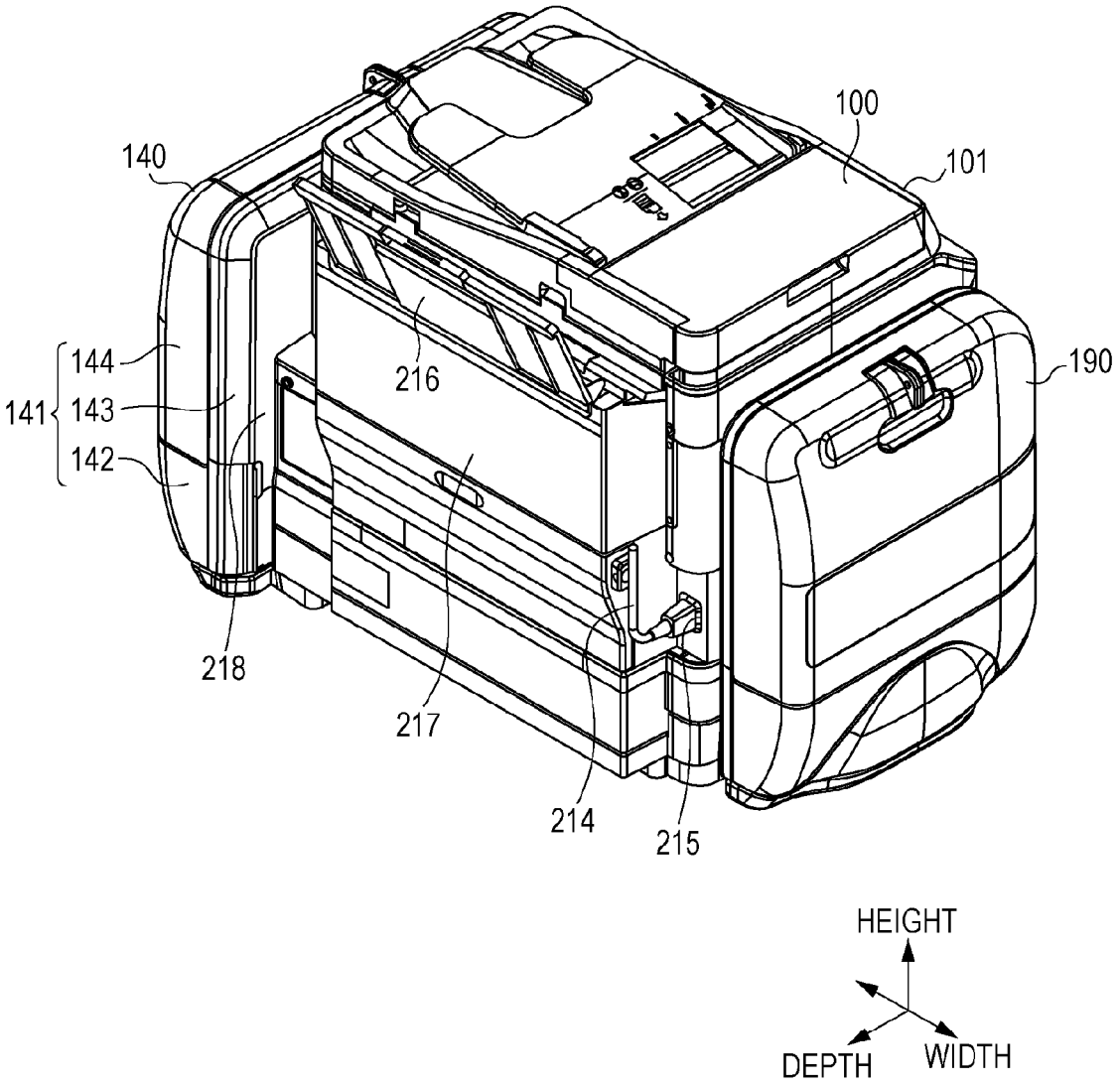
FIG. 24 is a perspective view of the recording apparatus illustrating a rear surface of the recording apparatus.
Figure 25:
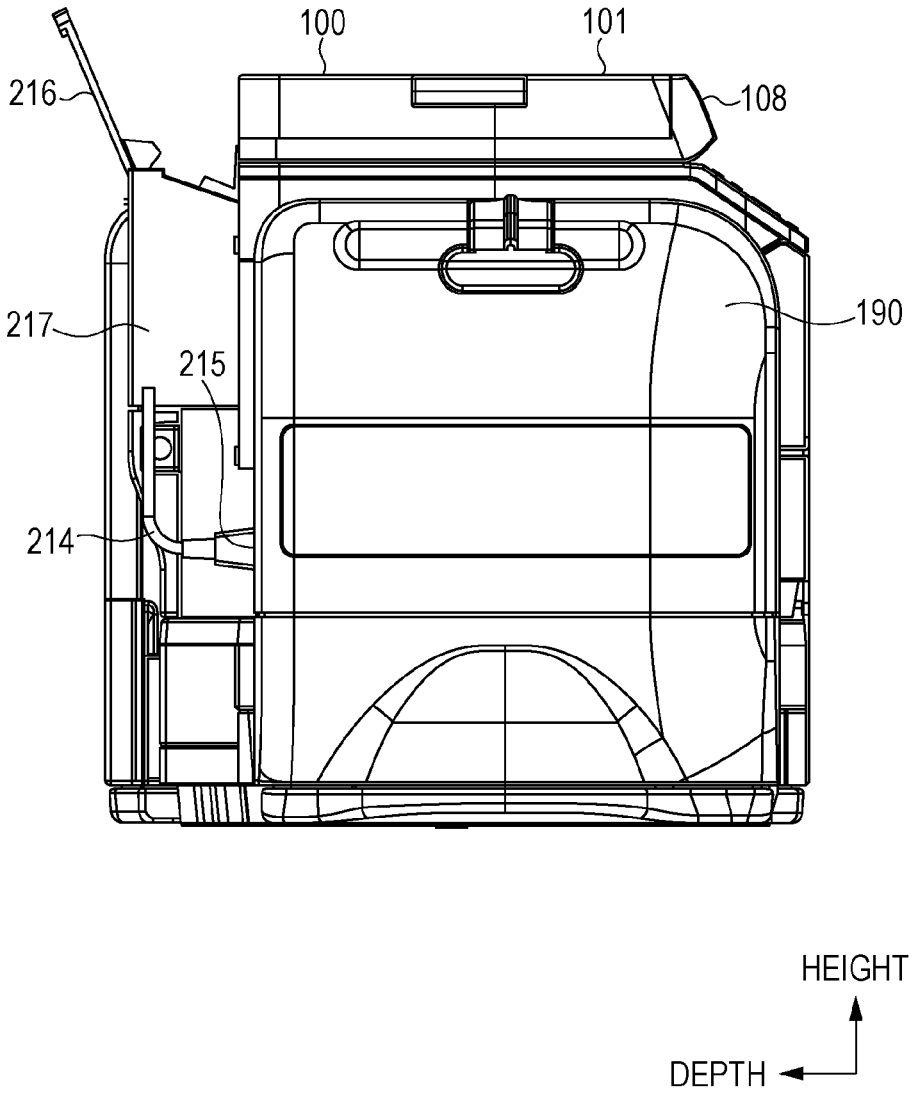
FIG. 25 is a left side view of the recording apparatus.

As illustrated in FIGS. 24 and 25, on a rear surface of the housing 101, an electrical outlet 215, in which a power cord 214 is connected to the end portion of the left side surface side, is provided. In addition, on the rear surface of the housing 101, a loading tray 216 for loading the paper sheet P, and a paper sending portion 217 which sends the paper sheet P loaded on the loading tray 216 into the housing 101, are provided. The loading tray 216 and the paper sending portion 217 are protruded to the farther side in the depth direction of the printer than the electrical outlet 215. For this reason, when the second liquid storing unit 190 which is mounted on the left side surface is greatly protruded to a further side than the electrical outlet 215 of the housing 101, both side portions of the electrical outlet 215 are in a blocked state, and there is a concern that it is difficult to plug and unplug the power cord 214 with respect to the electrical outlet 215. In the embodiment, since the second liquid storing unit 190 is mounted on the left side surface of the housing 101 so that the second liquid storing unit 190 is not positioned on a further side than the electrical outlet 215 in the depth direction of the printer, the user can easily access the electrical outlet 215, and easily plug and unplug the power cord 214.

Figure 26:
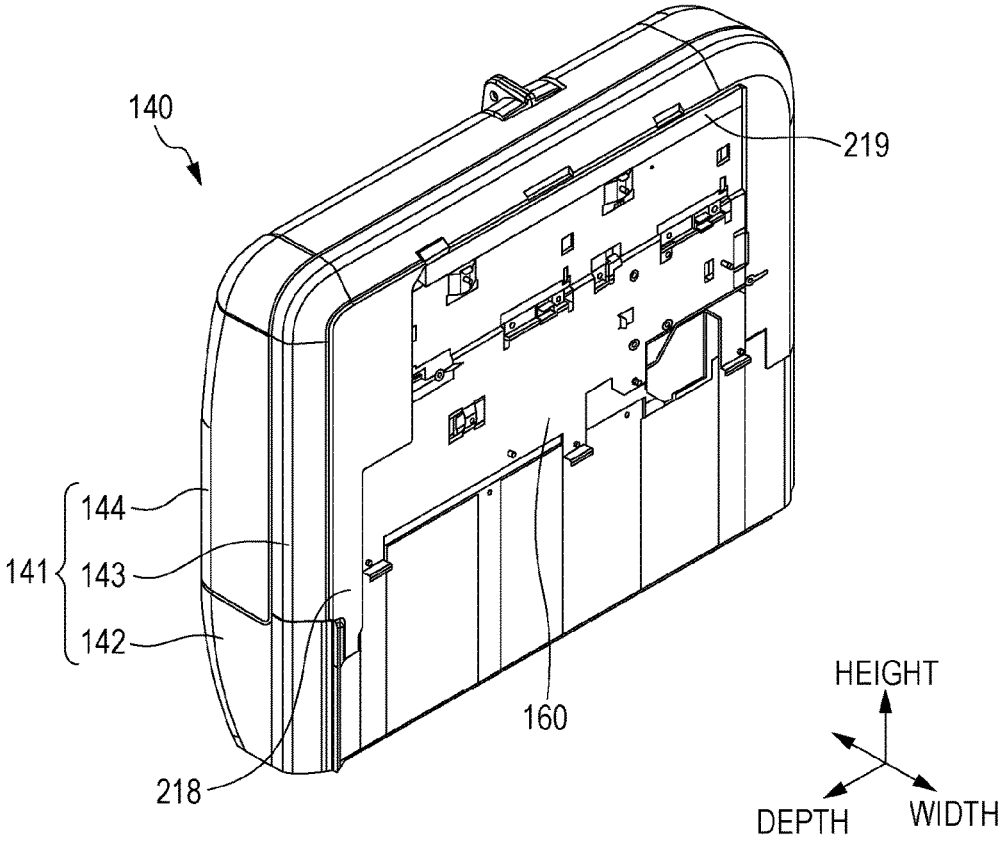
FIG. 26 is a perspective view of the first liquid storing unit to which the outer sheet metal is attached.

In addition, as illustrated in FIGS. 24 and 26, the case 141 of the first liquid storing unit 140 is mounted on the housing 101 in a state of being projected on the far side in the depth direction of the printer. For this reason, a decorative sheet 218 which covers the part projected to the far side is attached to the outer surface of the case 141. In addition, as illustrated in FIG. 26, a sponge 219 which is an example of a sealing member is attached to an upper end of the outer sheet metal 160. For this reason, when the first liquid storing unit 140 is attached to the housing 101, the sponge 219 is in a state of being nipped between the case 141 and the housing 101. Accordingly, the void between the housing 101 and the case 141 is blocked.

According to the first embodiment described above, operation effects described below are obtained.

(1) The case 141 is mounted on the right side surface of the housing 101 in a state of being inclined with respect to the depth direction of the printer so that the outer surface of the case 141 of the first liquid storing unit 140 is positioned on the inner side in the depth direction of the printer as approaching to the near side in the depth direction of the printer. In other words, when the printer is viewed from the front surface, the case 141 is inclined so that the part which is on the nearest side of the outer surface in the case 141 becomes close to the right side surface of the housing 101. For this reason, compared to a case where the case 141 is mounted without inclination with respect to the depth direction of the printer, the void between the housing 101 and the case 141 which is seen from the front surface becomes smaller. Therefore, the void between the housing 101 and the case 141 becomes less remarkable.

(2) Since the case 141 is formed in a shape of a substantially rectangular parallelepiped, and the case 141 is mounted on the right side surface of the housing 101 in a state of being inclined with respect to the depth direction of the printer as described above, the width of the printer including the case 141 becomes wider as approaching the far side in the depth direction of the printer. For this reason, when viewed from the front view, the side wall of the printer is unlikely to be recognized as recessed.

(3) In the depth direction of the printer, the first liquid storing unit 140 and the second liquid storing unit 190 are positioned on a further side than the part on the nearest side of the housing 101. For this reason, the cases 141 and 191 are not in a more projected shape on the near side than the housing 101, the cases 141 and 191 are unlikely to become obstacles.

(4) The right side wall portion 111 of the middle housing 110 is inclined with respect to the height direction of the printer to be positioned on the outer side as approaching the lower part with respect to the height direction of the printer. The case 141 of the first liquid storing unit 140 is mounted on the housing 101 in a state of being inclined with respect to the height direction of the printer at the equivalent angle to the inclination angle of the left side wall portion 112 to be along the left side wall portion 112. For this reason, at the upper part and the lower part of the printer, generation of the void between the housing 101 and the case 141 is suppressed.

(5) The left side wall portion 112 of the middle housing 110 is inclined with respect to the height direction of the printer to be positioned on the outer side as approaching the lower part with respect to the height direction of the printer. The case 191 of the second liquid storing unit 190 is mounted on the housing 101 in a state of being inclined with respect to the height direction of the printer at the equivalent angle to the inclination angle of the left side wall portion 112 to be along the left side wall portion 112. For this reason, at the upper part and the lower part of the printer, generation of the void between the housing 101 and the case 191 is pressed.

(6) The sponge 219 is nipped between the case 141 of the first liquid storing unit 140 and the housing 101. For this reason, the void between the housing 101 and the case 141 is blocked by the sponge 219, and it is possible to prevent an object from getting into the void between the housing 101 and the case 141.

In addition, the above-described embodiment may be changed as follows.

Figure 27:
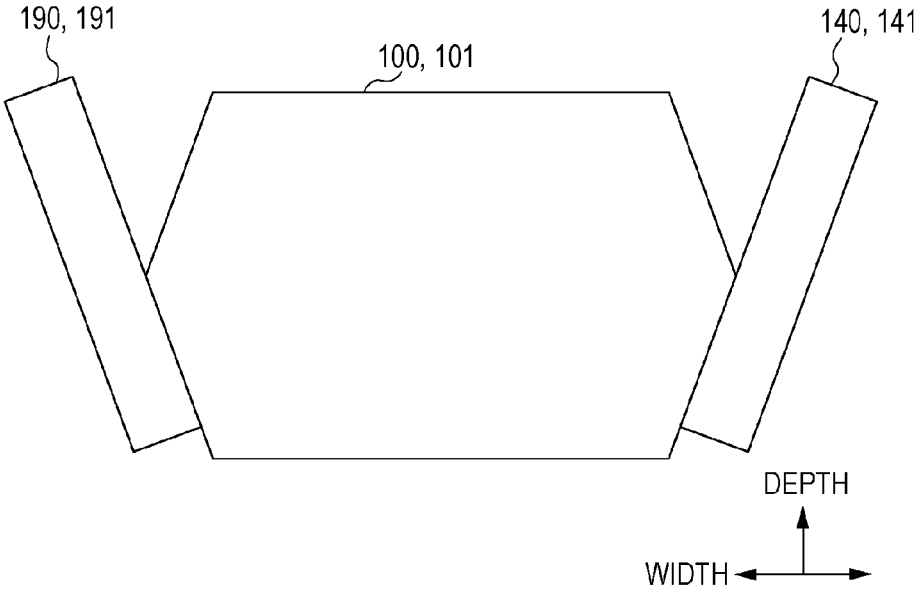
FIG. 27 is a schematic view illustrating a configuration of the recording apparatus when another example of the recording apparatus is viewed from above.

In the above-described embodiment, the second liquid storing unit 190 is mounted on the left side surface of the housing 101 without inclination with respect to the depth direction of the printer. However, the second liquid storing unit 190 may be mounted being inclined with respect to the depth direction of the printer. In other words, the second liquid storing unit 190 may be mounted on the housing 101 in a state of being inclined with respect to the depth direction of the printer so that the outer surface which opposes the housing 101 in the case 191 of the second liquid storing unit 190 is positioned on the inner side in the width direction of the printer as approaching the near side in the depth direction of the printer. In addition, this configuration can be realized by changing the level of protrusion of the fastening portion 205 of the outer sheet metal 199 with respect to the outer sheet metal 199 in the depth direction of the printer. As illustrated in FIG. 27, this configuration is particularly effective when both side surfaces of the housing 101 has an outwardly bent shape.

In the above-described embodiment, the void between the housing 101 and the case 141 is blocked by attaching the sponge 219 to the upper end of the outer sheet metal 160 which is attached to the first liquid storing unit 140. However, for example, the sponge 219 may be attached to other parts of the outer sheet metal 160, such as a front end of the outer sheet metal 160.

In the above-described embodiment, the void between the housing 101 and the case 141 is blocked by attaching the sponge 219 to the upper end of the outer sheet metal 160 which is attached to the first liquid storing unit 140. However, the sponge 219 may be attached to the outer sheet metal 199 which is attached to the second liquid storing unit 190. In this configuration, it is possible to further block the void between the housing 101 and the case 191.

In the above-described embodiment, an example in which the sponge is nipped between the first liquid storing unit 140 and the housing 101 as a sealing member is described. However, other members, such as rubber, may be nipped as the sealing member. In addition, such a sealing member may not be provided. Even when the sealing member is not provided, it is possible to obtain the effects in the above-described (1) to (5).

In the above-described embodiment, the case 191 of the second liquid storing unit 190 is mounted on the housing 101 in a state of being inclined with respect to the height direction of the printer to be along the left side wall portion 112. Instead of this configuration, the case 191 may be mounted on the housing 101 without inclination with respect to the height direction of the printer. Even in this configuration, it is possible to obtain the effects in the above-described (1) to (4).

In the above-described embodiment, the case 141 of the first liquid storing unit 140 is mounted on the housing 101 in a state of being inclined with respect to the height direction of the printer to be along the right side wall portion 111. Instead of this configuration, the case 141 may be mounted on the housing 101 without inclination with respect to the height direction of the printer. Even in this configuration, it is possible to obtain the effects in the above-described (1) to (3).

In the above-described embodiment, an example in which both side surfaces of the housing 101 are molded in a form which is inclined with respect to the height direction of the printer is described. However, any one of the side surfaces of the housing 101 may not be inclined with respect to the height direction of the printer. In addition, both side surfaces of the housing 101 may not be inclined with respect to the height direction of the printer.

In the above-described embodiment, both the first liquid storing unit 140 and the second liquid storing unit 190 are positioned on a further side than the part on the nearest part of the housing 101 in the depth direction of the printer. However, only one of these may be positioned on the far side. In addition, both the first liquid storing unit 140 and the second liquid storing unit 190 may be protruded to a nearer side than the part on the nearest side of the housing 101 in the depth direction of the printer. Even in this configuration, it is possible to obtain the effects in the above-described (1) to (2).

In the above-described embodiment, an example in which the width of the printer becomes wider as approaching the far side in the depth direction of the printer is described. However, this configuration is not necessarily provided. Even when the width of the printer does not become wider as approaching the far side in the depth direction of the printer, it is possible to obtain the effect in the above-described (1).

In the above-described embodiment, in the depth direction of the printer, both side surfaces of the housing 101 are molded in a slightly curved shape so that the length of the printer in the width direction becomes shorter as approaching the near side and the far side, that is, so that the center part is protruded to the outer side in the width direction of the printer. Instead of this configuration, at least one of both side surfaces of the housing 101 may be formed without a curve.

In the above-described embodiment, the void is provided between the scanner portion 108 of the housing 101 and the outer sheet metal 160. However, the void may not be provided as the outer sheet metal 160 abuts against the wall surface of the scanner portion 108.

In the above-described embodiment, the scanner portion 108 is provided in the housing 101. However, the scanner portion may not be necessarily provided.

In the above-described embodiment, the number of the insertion portions 178 which are provided at the lower end of the outer sheet metal 160 of the first liquid storing unit 140 may be appropriately changed. In addition, the number of the insertion portions 210 which are provided at the lower end of the outer sheet metal 199 of the second liquid storing unit 190 may be appropriately changed.

In the above-described embodiment, the insertion portion 210 is provided at the lower end of the outer sheet metal 199 of the second liquid storing unit 190, and the insertion portion 210 is stuck in the housing 101 from above. However, the insertion portion 210 may not be necessarily provided.

In the above-described embodiment, the cutout hole 212 is formed at the part which is not overlapped with the stay 195 which is attached to the inner surface of the case 191 of the second liquid storing unit 190, and the inner sheet metal 161 and the outer sheet metal 199 are installed so that the screw holes 162 and 206 which are respectively formed in the inner sheet metal 161 and the outer sheet metal 199 are overlapped with the cutout hole 212. Instead of this configuration, the inner sheet metal 161 and the outer sheet metal 199 may be installed at a position where the cutout hole 212 and the screw holes 162 and 206 are not overlapped with each other. In addition, the cutout hole 212 may be omitted.

In the above-described embodiment, the insertion portion 178 is provided at the lower end of the outer sheet metal 160 of the first liquid storing unit 140, and the insertion portion 178 is stuck in the housing 101 from above. However, the insertion portion 178 is not necessarily provided.

In the above-described embodiment, the cutout hole 129 is formed at the part which is not overlapped with the stay 153 which is attached to the inner surface of the case 141 of the first liquid storing unit 140, and the inner sheet metal 161 and the outer sheet metal 160 are installed so that the screw holes 162 and 172 which are respectively formed in the inner sheet metal 161 and the outer sheet metal 160 are overlapped with the cutout hole 129. Instead of this configuration, the inner sheet metal 161 and the outer sheet metal 160 may be installed at a position where the cutout hole 129 and the screw holes 162 and 172 are not overlapped with each other. In addition, the cutout hole 129 may be omitted.

In the above-described embodiment, a configuration, in which there are four attaching holes 116 into which the inner sheet metals 161 are pressed in the right side wall portion 111 of the middle housing 110, is described as an example. However, the number of the attaching holes 116 may be appropriately changed. In addition, when there are two or more attaching holes 116, it is preferable that at least one of the attaching holes 116 is attached to have a different orientation in which the long hole 166 extends from that of other inner sheet metals 161.

In the above-described embodiment, a configuration, in which there are four attaching holes 202 into which the inner sheet metals 161 are pressed in the left side wall portion 112 of the middle housing 110, is described as an example. However, the number of the attaching holes 202 may be appropriately changed. In addition, when there are two or more attaching holes 202, it is preferable that at least one of the attaching holes 202 is attached to have a different orientation in which the long hole 166 extends from that of other inner sheet metals 161.

In the above-described embodiment, the inner sheet metal 161 which is pressed into the attaching hole at the upper part of the side surface of the housing 101 is attached in a different direction in which the long hole 166 extends from that of the inner sheet metal 161 which is pressed into the attaching hole at the lower part. In contrast, the inner sheet metal 161 may be attached in the same direction in which the long hole 166 extends as that of the inner sheet metal 161 which is pressed into the attaching hole provided below.

In the above-described embodiment, the inner sheet metal 161 is pressed into the attaching holes 116 and 202 which are provided on the side surface of the housing 101 made of resin. However, the inner sheet metal 161 may be fixed by other methods except pressing. For example, the inner sheet metal 161 may be fixed by a method of adhering the inner sheet metal 161 to the outer surface of the housing 101, or the like.

In the above-described embodiment, the inner sheet metal 161 and the outer sheet metals 160 and 199 are fastened with each other by inserting the screws 131 and 220 from the outer sheet metals 160 and 199 sides. However, the inner sheet metal 161 and the outer sheet metals 160 and 199 may be fastened with each other by inserting the screws 131 and 220 from the inner sheet metal 161 side.

In the above-described embodiment, the inner sheet metal 161 is attached to the inner surface of the housing 101, and the outer sheet metal 160 is attached to the outer surface of the case 141. However, the inner sheet metal 161 may be attached to the outer surface of the housing 101, and the outer sheet metal 160 may be attached to the inner surface of the case 141.

In the above-described embodiment, a configuration in which the liquid storing units 140 and 190 are mounted on both side surfaces of the housing 101 is described as an example. However, only one of the liquid storing units 140 and 190 may be provided. In addition, in this case, the liquid storing unit is mounted on the side surface of the housing in a state where the case is inclined with respect to the depth direction of the printer so that the outer surface of the case of the liquid storing unit is positioned on the inner side in the width direction of the printer as approaching the near side in the depth direction of the printer.

In the above-described embodiment, a recording apparatus in which the direction in which the sign of the operating panel 104 faces is the same as the direction in which the discharge port 105 is provided is described as an example. However, these directions may be different from each other. In addition, when the operating panel 104 is provided on the upper surface of the housing, and the sign of the operating panel 104 faces upward, or when the operating panel is not provided, the direction in which the discharge port 105 is provided is considered as the front surface of the printer and the housing 101. The case is mounted on at least one of the right side surface and the left side surface of the housing with respect to the front surface, and the case is mounted on the housing in a state of being inclined with respect to the depth direction of the printer so that the outer surface which opposes the housing in the case is disposed on the inner side in the width direction of the printer as approaching the near side in the depth direction of the printer.

In the above-described embodiment, the direction in which the sign of the operating panel 104 faces is considered as the front surface of the printer and the housing 101. However, the side on which the operating panel 104 is provided may be the front surface of the printer and the housing 101.

In the above-described embodiment, an example in which the power cord 214 is connected to the electrical outlet 215 of the housing 101 is described. However, a USB cable, a LAN cable, or a memory card may be connected to the electrical outlet 215.

Figure 28:
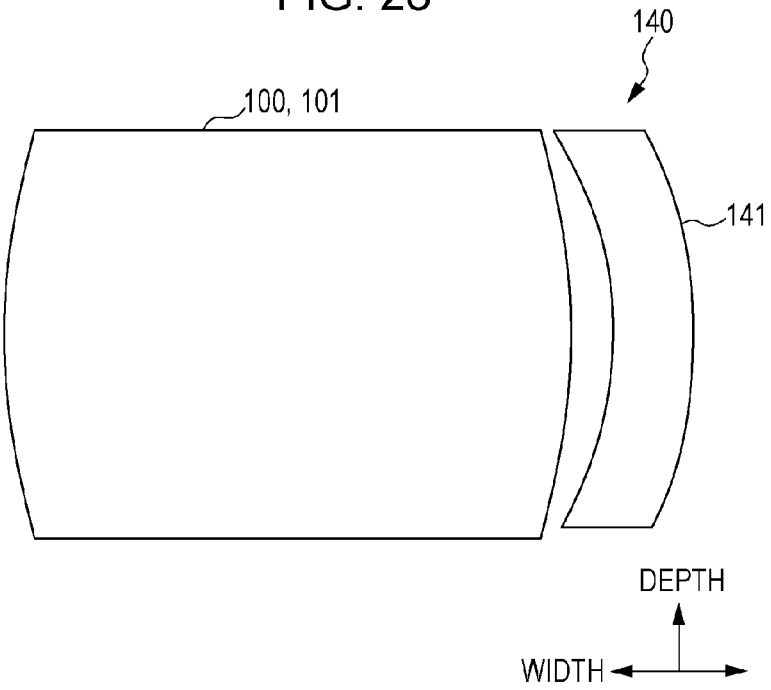
FIG. 28 is a schematic view illustrating a configuration of the recording apparatus when another example of the recording apparatus is viewed from above.

In the above-described embodiment, an example in which the cases 141 and 191 which have a shape of a substantially rectangular parallelepiped is described. However, as illustrated in FIG. 28, a case in a curved shape may be provided. In addition, in this case, as illustrated in FIG. 28, the case 141 may be curved more than the curved side surface of the housing 101.

In the above-described embodiment, in the depth direction of the printer, the second liquid storing unit 190 is mounted on the left side surface of the housing 101 so that the second liquid storing unit 190 is not positioned on a further side than the electrical outlet 215. However, the second liquid storing unit 190 may be mounted to be positioned on a further side than the electrical outlet 215.

In the above-described embodiment, the electrical outlet 215 is provided in the end portion on the left side surface side of the rear surface of the printer. However, the installation position of the electrical outlet 215 is not limited thereto, and for example, the electrical outlet 215 may be provided in the end portion on the right side surface side of the rear surface of the printer. In addition, when the electrical outlet 215 is provided in the end portion on the right side surface side of the rear surface of the printer, in the depth direction of the printer, it is preferable that the first liquid storing unit 140 is mounted on the housing 101 to be positioned on a further side than the electrical outlet 215.

In the above-described embodiment, by the outer sheet metal 160, the case is mounted on the housing 101 in a state of being inclined with respect to depth direction of the printer so that the outer surface of the case 141 is positioned on the inner side in the width direction of the printer as approaching the near side in the depth direction of the printer. Instead of this configuration, for example, a plurality of fastening portions which are protruded to the housing 101 side from the outer surface of the case 141, and have a different level of protrusion from each other in the depth direction of the printer, are provided. By fastening theses fastening portions with the inner sheet metal 161, the case 141 may be mounted on the housing 101 in a state of being inclined with respect to depth direction of the printer. In addition, the inner sheet metal 161 may be omitted, and the case may be directly fastened to the side surface of the housing 101.

In the above-described embodiment, the recording apparatus may be a liquid ejecting apparatus which performs recording by ejecting or emitting other types of liquid other than the ink. For example, a liquid body ejecting apparatus, which performs recording by ejecting a liquid body including dispersed or melted materials, such as an electrode material or a coloring material (pixel material) which are used in manufacturing a liquid crystal display, an electroluminescence (EL) display, and a surface light emitting display, may be employed. In addition, a fluid ejecting apparatus, which ejects fluid, such as gel (for example, physical gel), may be employed.

This application is a Divisional of U.S. application Ser. No. 14/639,353 filed Mar. 5, 2015, which is expressly incorporated herein by reference. U.S. patent application Ser. No. 14/639,353 claims the benefit of and priority to Japanese Patent Application No.: 2014-052605, filed Mar. 14, 2014 is expressly incorporated by reference herein.

What is claimed is:

1. A recording apparatus, comprising:

a recording portion which performs recording on a recording medium by ejecting liquid;

a housing of the recording apparatus in which the recording portion is stored;

a liquid storing body which stores liquid supplied to the recording portion; and a case which accommodates the liquid storing body, wherein, when a discharge port which discharges the recording medium is provided on the housing, and a direction in which the discharge port is provided is considered as a front surface of the recording apparatus and also the housing, the case is mounted on at least one of a right side surface and a left side surface which intersect the front surface of the housing, and wherein, the case is mounted on at least one of the right side surface and the left side surface of the housing in an inclined state, the side surface of the housing to which the case is mounted on at least one of the right side and the left side surface of the housing has a protruding curved surface, the case being inclined in a depth direction of the housing towards the front surface of the housing, an outer surface which opposes the housing being positioned on an inner side of the recording apparatus in a width direction as the outer surface approaches the front surface of the recording apparatus in the depth direction to thereby suppress any voids between the housing and the case when the case is mounted on the at least one of the right side surface or the left side surface, wherein the protruding curved surface of the side surface of the housing is positioned at a center point of the housing in the depth direction such that a length of the housing in the width direction decreases as approaching the front surface and a rear surface from the center point, the rear surface being opposite the front surface.

2. The recording apparatus according to claim 1, wherein a width of the recording apparatus on a near side is narrower than that in a center portion in the depth direction.

3. The recording apparatus according to claim 2, wherein a first sheet metal is provided on a surface on the housing side of the case, wherein a second sheet metal is provided on a surface on a side opposite to the case of the housing, and wherein the first sheet metal and the second sheet metal are fastened with each other by a fastening member.

4. The recording apparatus according to claim 3, wherein the first sheet metal protrudes to the housing side in accordance with the width of the case.

5. The recording apparatus according to claim 4, wherein a sealing member is nipped between the housing and the case.

6. The recording apparatus according to claim 1, wherein a front surface of the case is perpendicular to the discharge port.

7. The recording apparatus according to claim 1, wherein an outer surface of the case is positioned on an inner side of the recording apparatus at a near side of the recoding apparatus, and inclined in a height direction of the housing.

* * * * *